US006255029B1

(12) United States Patent
Hirose et al.

(10) Patent No.: US 6,255,029 B1
(45) Date of Patent: Jul. 3, 2001

(54) PROCESS FOR PREPARING A COLOR TONER FOR DEVELOPING AN ELECTROSTATIC IMAGE

(75) Inventors: Naohiro Hirose; Mikio Kohyama; Kenji Hayashi; Tomoe Kitani; Yoshiki Nishimori, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/378,898

(22) Filed: Aug. 23, 1999

(30) Foreign Application Priority Data

Aug. 28, 1998 (JP) ..... 10-243402

(51) Int. Cl.[7] ..... G03G 9/097
(52) U.S. Cl. ..... 430/137; 430/109
(58) Field of Search ..... 430/109, 110, 430/124, 137

(56) References Cited

U.S. PATENT DOCUMENTS 5,700,617 * 12/1997 Takiguchi et al. ..... 430/110
5,856,055 * 1/1999 Ugai et al. ..... 430/110
5,972,553 * 10/1999 Katada et al. ..... 430/110

* cited by examiner

*Primary Examiner*—John Goodrow

(74) *Attorney, Agent, or Firm*—Jordan B. Bierman; Bierman, Muserlian and Muserlian

(57) ABSTRACT

A process for preparing a color toner for developing an electrostatic image comprising a step of polymerizing monomers to obtain resin particles, wherein the color toner comprises primary particles or secondary particles of resin particles, and a metal complex dye represented by the following formula (1) or formula (2), Formula (1)

$$M\text{--}[\text{-}X^1{=}{=}L^1{-}(\text{-}L^2{=}{=}L^3\text{-})_m\text{-}Y^1]_{n1}$$

Formula (2)

$$M\text{--}[\text{-}X^3{-}N{=}{=}N{-}Y^3]_{n2}$$

wherein, $X^1$ and $X^3$ each are a group of atoms bonding with each other which can form at least bidentate coordination bond with a metal ion; $Y^1$ represents an aromatic hydrocarbon ring, a 5- or 6-membered heterocyclic ring or $-L^4{=}Y^2$; $Y^2$ and $Y^3$ each represent an aromatic hydrocarbon ring or a 5- or 6-membered heterocyclic ring; $L^1$ and $L^4$ each represent a substituted or an unsubstituted methine group or a nitrogen atom; $L^2$ and $L^3$ each represent a substituted or an unsubstituted methine group; M represents a metal ion which can form at least a bidentate coordination bond with said group of atoms bonding with each other represented by $X^1$ and $X^3$; m represents an integer of 0, 1, 2 or 3; n1 and n2 each represent an integer of 1, 2 or 3.

21 Claims, No Drawings

PROCESS FOR PREPARING A COLOR TONER FOR DEVELOPING AN ELECTROSTATIC IMAGE

FIELD OF THE INVENTION

The present invention relates to a process for preparing a color toner for developing an electrostatic image.

BACKGROUND OF THE INVENTION

As color toners for color copiers and color printers, at present, mainly employed are toners produced in a pulverizing method. In recent years, however, requirements for an enhanced image quality have been continuously increased and particles of smaller particle size and narrower particle distribution have been able to be produced at a lower cost. Therefore, manufacturing methods for the toners employing an emulsion polymerization method, a suspension polymerization method and a dispersion polymerization method, and the like, have been strongly encouraged [for example, an emulsion polymerization method described in Japanese Patent Publication Open to Public Inspection (hereinafter referred to as JP-A) Nos. 63-186253, 6-329947, a suspension polymerization method described in JP-A No. 9-15904, and a dispersion polymerization method described in JP-A No. 8-320594].

As properties required for the color of such toners, not only color reproduction and image transmittance for overhead projectors (hereinafter referred to as OHP) but also light fastness is enumerated in order to consistently maintain these properties. The above-mentioned OHP image transmission rate refers to the OHP image transparency rate, and the degree of the variation in hue between the color of light transmitted through the OHP image and the color of light obtained by the reflection of said transmitted light on paper.

When a toner comprising a pigment as the colorant is employed, good light fastness is obtained. However, on account of insolubility of the pigment, a dispersed particle having a diameter of tens of nm to hundreds of nm is formed and problems are caused such as a decrease in the transparency and the hue variation in the color of transmitted light. When a toner is employed which comprises a pigment, for example, such as quinacridone red, which is one of the quinacridone type pigments, described in JP-A No. 63-186253, a disazo pigment, C.I. PIGMENT YELLOW 12, 13, 14, 16, and 17 described in JP-A Nos. 2-210363, 62-157051, 62-255956, C.I. PIGMENT YELLOW 185 described in JP-A No. 6-118715, the pigment is insoluble and tends to coagulate, forming dispersed particle having a diameter of tens of nm to hundreds of nm, through the secondary particle and further, the tertiary particle. As a result, problems such as a decrease in saturation and transparency of the OHP image are caused.

As countermeasures against such problems, the pigment is previously treated with a flushing method, a master batch method, etc., and the resulting treated pigment is then employed. When employing the countermeasures, the increase in cost is not avoided because of the increase in the number of manufacturing processes.

On the other hand, when a toner comprising a dye as the colorant is employed, the transparency of the OHP image is excellent because the dye is soluble and is sufficiently dispersed. However, there occurs a problem such that the light fastness is inferior to that of pigments. There are known dyes such as tannic acid salt of ORANGE II described in JP-A No. 63-186253, PTA salt of VICTORIA BLUE described in JP-A No. 63-186253, C.I. SOLVENT YELLOW 162 described in JP-A No. 3-276161, C.I. DIRECT YELLOW 160 described in JP-A No. 2-20747 and C.I. SOLVENT YELLOW described in 2-207273. These dyes produce OHP images having high transparency and no hue variation. However, as compared to the pigment type, the light fastness is inferior and consistent properties can not be obtained over a long period of time.

SUMMARY OF THE INVENTION

An object of the present invention is to provide a process for preparing a color toner for developing an electrostatic image giving high saturation in hue without a previously specified treatment and enhanced light fastness, as well as less hue variation and further higher transparency of the OHP images, by employing a colorant with excellent light fastness which can be sufficiently dispersed in a binder resin.

DETAILED DESCRIPTION OF THE INVENTION

The above-mentioned object of the present invention is attained by the following constitution.

(1) A process for preparing a color toner for developing an electrostatic image comprising a step of polymerizing monomers to obtain resin particles, wherein the color toner comprises primary particles or secondary particles of resin particles, and a metal complex dye represented by the following formula (1) or formula (2), Formula (1)

$$M\text{-}[\text{-}X^1{=}L^1{-}(\text{-}L^2{=}L^3)_m\text{-}Y^1]_{n1}$$

Formula (2)

$$M\text{-}[\text{-}X^3{-}N{=}N{-}Y^3]_{n2}$$

wherein, $X^1$ and $X^3$ each are a group of atoms bonding with each other which can form at least bidentate coordination bond with a metal ion; $Y^1$ represents an aromatic hydrocarbon ring, a 5- or 6-membered heterocyclic ring or $-L^4{=}Y^2$; $Y^2$ and $Y^3$ each represent an aromatic hydrocarbon ring or a 5- or 6-membered heterocyclic ring; $L^1$ and $L^4$ each represent a substituted or an unsubstituted methine group, or a nitrogen atom; $L^2$ and $L^3$ each represent a substituted or an unsubstituted methine group; M represents a metal ion which can form at least a bidentate coordination bond with said group of atoms bonding with each other represented by $X^1$ and $X^3$; m represents an integer of 0, 1, 2 or 3; n1 and n2 each represent an integer of 1, 2 or 3.

(2) A process for preparing a color toner for developing an electrostatic image comprising the following steps of;

(a) polymerizing monomers to obtain resin particles, (b) associating said resin particles, wherein the color toner comprises the associated resin particles, and a metal complex dye represented by the following formula (1) or formula (2), Formula (1)

$$M\text{-}[\text{-}X^1{=}L^1{-}(\text{-}L^2{=}L^3)_m\text{-}Y^1]_{n1}$$

Formula (2)

$$M\text{-}[\text{-}X^3{-}N{=}N{-}Y^3]_{n2}$$

wherein, $X^1$ and $X^3$ each are a group of atoms bonding with each other which can form at least bidentate coordination bond with a metal ion; $Y^1$ represents an aromatic hydrocarbon ring, a 5- or 6-membered heterocyclic ring or —$L^4$═$Y^2$; $Y^2$ and $Y^3$ each represent an aromatic hydrocarbon ring or a 5- or 6-membered heterocyclic ring; $L^1$ and $L^4$ each represent a substituted or an unsubstituted methine group, or a nitrogen atom; $L^2$ and $L^3$ each represent a substituted or an unsubstituted methine group; M represents a metal ion which can form at least a bidentate coordination bond with said group of atoms bonding with each other represented by $X^1$ and $X^3$; m represents an integer of 0, 1, 2 or 3; $n_1$ and n2 each represent an integer of 1, 2 or 3.

(3) The process of item 2, wherein the absorption maximum of said metal complex dye represented by the formula (1) or formula (2) described above is between 350 and 850 nm.

(4) The process of item 2, wherein said metal complex dye is added prior to the completion of an association of resin particles.

(5) The process of item 2, wherein said metal complex dye represented by the formula (1) described above is represented by the following formula (3) or formula (4);

Formula (3)

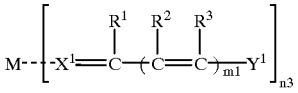

Formula (4)

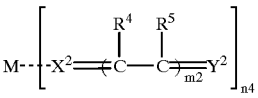

wherein, $X^1$ and $X^2$ each are a group of atoms bonding with each other which can form at least a bidentate coordination bond with a metal ion; $R^1$, $R^2$, $R^3$, $R^4$ and $R^5$ each represent a hydrogen atom or a monovalent substituent group; $Y^1$ and $Y^2$ each represent an aromatic hydrocarbon ring or a 5- or 6-membered heterocyclic ring; M represents a metal ion which can form at least a bidentate coordination bond with said group of atoms bonding with each other represented by $X^1$ or $X^2$; m1 or m2 represents an integer of 0, 1, 2 or 3; n3 or n4 represents an integer of 1, 2 or 3.

(6) The process of item 5, wherein $X^1$ or $X^2$ of the formula (3) or formula (4) is represented by the following formula (8), formula (9), formula (10) or formula (11)

Formula (8)

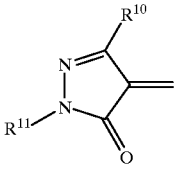

Formula (9)

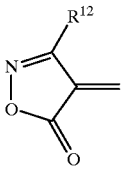

-continued

Formula (10)

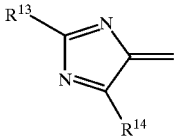

Formula (11)

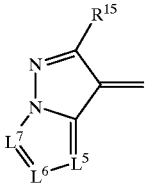

wherein $L^5$ represents a nitrogen atom or —$CR^{17}$═; $L^6$ represents a nitrogen atom or —$CR^{18}$═; $L^7$ represents a nitrogen atom or —$CR^{19}$═; $R^{17}$, $R^{18}$ and $R^{19}$ represent a hydrogen atom or a monovalent substituent group; at least one of $R^{17}$, $R^{18}$ and $R^{19}$ represents a group of atoms bonding with each other which can form at least a bidentate coordination bond with a nitrogen atom of the formula (11); $R^{10}$, $R^{11}$, $R^{12}$, $R^{13}$, $R^{14}$ and $R^{15}$ each represent a hydrogen atom or a monovalent substituent group; at least one of $R^{10}$ and $R^{11}$ represents a group of atoms bonding with each other which can form at least a bidentate coordination bond with a nitrogen atom of the formula (8); $R^{12}$ represents a group of atoms bonding with each other which can form at least a bidentate coordination bond with a nitrogen atom of the formula (9); at least one of $R^{13}$ and $R^{14}$ represents a group of atoms bonding with each other which can form at least a bidentate coordination bond with a nitrogen atom of the formula (10).

(7) The process of item 6, wherein a colorant is represented by the formula (3) or formula (4) described above.

(8) The process of item 5, wherein a colorant contains at least a metal complex dye represented by the following formula (3), Formula (3)

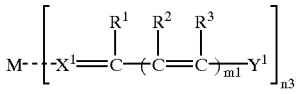

wherein, $X^1$ is a group of atoms bonding with each other which can form at least a bidentate coordination bond with a metal ion; $R^1$, $R^2$ and $R^3$ each represent a hydrogen atom or a monovalent substituent group; $Y^1$ represent an aromatic hydrocarbon ring or a 5- or 6-membered heterocyclic ring; M represents a metal ion which can form at least a bidentate coordination bond with said group of atoms bonding with each other represented by $X^1$; m1 represents an integer of 0, 1, 2 or 3; n3 represents an integer of 1, 2 or 3.

(9) The process of item 5, wherein a colorant contains at least a metal complex dye represented by the following formula (4), Formula (4)

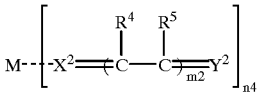

wherein, $X^2$ is a group of atoms bonding with each other which can form at least a bidentate coordination bond with a metal ion; $R^4$ and $R^5$ each represent a hydrogen atom or a monovalent substituent group; $Y^2$ represent an aromatic hydrocarbon ring or a 5- or 6-membered heterocyclic ring; M represents a metal ion which can form at least a bidentate coordination bond with said group of atoms bonding with each other represented by $X^2$; m2 represents an integer of 0, 1, 2 or 3; n4 represents an integer of 1, 2 or 3.

(10) The process of item 2, wherein at least two atoms, being contained in $X^1$ or $X^3$ of the metal complex dye represented by the formula (1) or formula (2) described above, and forming a coordination bond, are nitrogen atoms.

(11) The process of item 2, wherein a chemical structure represented by $X^1$ of the metal complex dye represented by the formula (1) described above is represented by the following formula (6)

Formula (6)

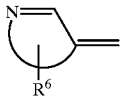

wherein $R^6$ represents a hydrogen atom or a monovalent substituent group.

(12) The process of item 2, wherein a chemical structure represented by $X^3$ of the metal complex dye represented by the formula (2) described above is represented by the following formula (7)

Formula (7)

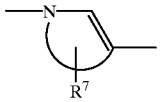

wherein $R^7$ represents a hydrogen atom or a monovalent substituent group.

(13) The process of item 2, wherein $X^1$ or $X^3$ of the formula (1) or formula (2) is represented by the formula (8), formula (9), formula (10) or formula (11) described above.

(14) The process of item 2, wherein said metal ion represented by M of the formula (1) and formula (2) is an ion of Ni, Cu, Co, Cr, Zn, Fe, Pd or Pt.

(15) The process of item 4, wherein said metal complex is dispersed in the presence of a water-soluble organic solvent having S.P. value of not less than 19 $J/m^3$ after the completion of adding said metal complex.

(16) The process of item 1, wherein a particle size of said primary particles of the resin particles is between 0.01 and 10 $\mu$m.

(17) The process of item 15, wherein a dispersion process is carried out in the presence of water and a water-soluble organic solvent.

(18) The process of item 17, wherein the weight ratio of said water-soluble organic solvent to water is between 1:99 and 1:1.

(19) The process of item 15, wherein an association process is carried out by adding a coagulant, or an aqueous solution containing said coagulant, as well as an infinitely water-soluble organic solvent.

(20) The process of item 1, wherein monomers are polymerized in the presence of said metal complex dye.

(21) The process of item 19, wherein said coagulant is added in an amount of not less than critical coagulation concentration, and said association process is carried out between a temperature of 5° C. higher than Tg of the resin particles and a temperature of 50° C. lower than Tg of the resin particles.

Namely, the color toner is produced through a polymerization toner manufacturing method of the present invention, and it is able to provide the color toner usable for developing an electrostatic image giving high saturation in hue without a previously specified treatment and enhanced light fastness, as well as less hue variation and further higher transparency of the OHP images, by employing a colorant with excellent light fastness which can be sufficiently dispersed in a binder resin.

The reason is not identified why the color toner produced in the present inventive method has a more excellent absorption coefficient and more excellent saturation in hue as well as transparency, compared with a color toner produced in a conventional polymerization method (for example, described in JP-A No. 6-329947) employing a pigment as a colorant. In addition, the reason is not also identified why the color toner produced in the present inventive method has more excellent light fastness as well as less hue variation, compared with a color toner produced in a conventional pulverizing method (for example, described in JP-A No. 10-20559) employing a metal complex dye.

However, the present inventive dye is sufficiently dispersed in a toner produced in a polymerization toner manufacturing method, and therefore, it is speculated that the inherent excellent light fastness of said dye is not lost. The toner according to the present invention is considered to exhibit the inherent excellent image durability and less hue variation, compared with a toner produced in a pulverizing method by which a molecular chain cleavage and colorant destruction due to excessive amount of heat generated while stirring and kneading said toner occur.

The present invention will now be explained in more detail.

The manufacturing method for the toner produced in this polymerization toner manufacturing method, as previously mentioned, is a manufacturing method, which is different from a pulverizing method, in which binder resin particles are associated to become a larger aggregate upon necessity, without a kneading pulverizing process, and the thus obtained toner particles are ready for a practical use. A colorant (a metal complex dye in the present invention) is contained in the toner particles during synthesizing of the binder resin or after the synthesizing process. The polymerization toner manufacturing method according to the present invention is, (i) a method in which a toner having desired particle size is directly obtained by polymerization, (ii) a method in which primary particles are produced by polymerization and the thus produced primary particles are associated to obtain a toner having desired particle size. The latter method is termed polymerization association method. As the former method, there are a suspension polymerization method, a dispersion polymerization method, and the like. With respect to the polymerization association method, primary particles are produced by an emulsion polymerization method, and after that said primary particles are associated in an association process. In the present invention, in point of dispersibility and precipitation of a colorant, the polymerization association method is preferable. Accordingly, the polymerization toner manufacturing method of the present invention is different from a pulverizing method in which a toner is produced through a kneading and pulverizing process.

The metal complex dye represented by the formula (1) or formula (2) will be detailed below. In this invention, the metal complex dye represented by the formula (1) is preferable to that represented by the formula (2), in view of excellent dispersibility, image durability and transparency.

In the above-mentioned formula (1) and formula (2), $X^1$ and $X^3$ each represent a group of atoms bonding with each other to form a ring structure which can form at least a bidentate coordination bond with a metal ion. Any dye included in the above-mentioned formula (1) and formula (2), which can form at least a bidentate coordination bond with a metal ion, can be used without limitation, however a so-called coupler residual group is preferable. Examples of said coupler residual group include 5-pyrazolone, imidazole, pyrazolopyrrole, pyrazoloimidazole, pyrazolotriazole, pyrazolotetrazole. barbituric acid, thiobarbituric acid, rhodanine, hydantoin, thiohydantoin, oxazolone, isooxazolone, indanedione, pyrazolidinedione, oxazolidinedione, hydroxypyridone or pyrazolopyridone.

The coupler residual group refers to a compound having an active hydrogen atom capable of forming a dye through coupling reaction with known p-phenylenediamines.

As $X^1$, the following formulas (16) through (23) are specifically preferable.

As $X^3$, the following formulas (24) through (31) are specifically preferable.

Formula (16)

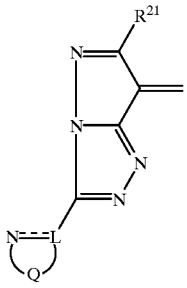

Formula (17)

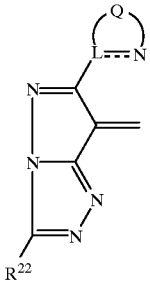

-continued

Formula (18)

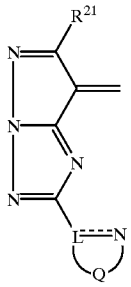

Formula (19)

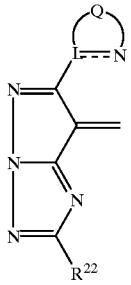

Formula (20)

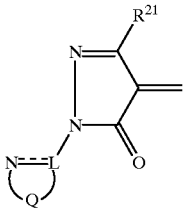

Formula (21)

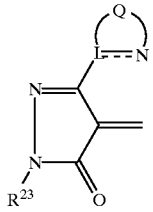

Formula (22)

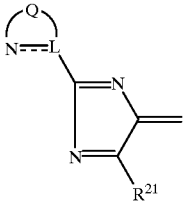

Formula (23)

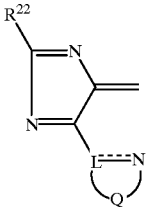

-continued

Formula (24)

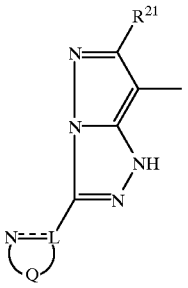

Formula (25)

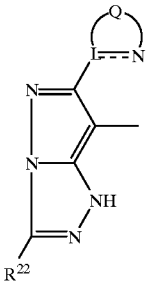

Formula (26)

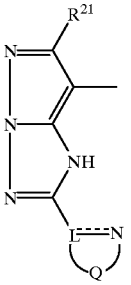

Formula (27)

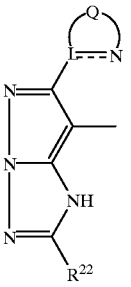

Formula (28)

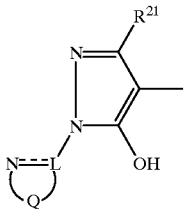

-continued

Formula (29)

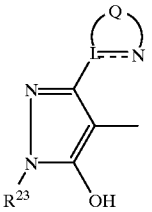

Formula (30)

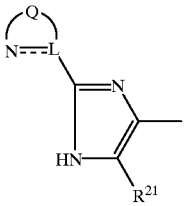

Formula (31)

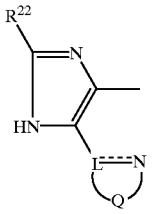

[Wherein, $R^{21}$, $R^{22}$ and $R^{23}$ each represent a hydrogen atom or a monovalent substituent group; L represents a carbon atom or a nitrogen atom; Q represents a group of atoms which can form a nitrogen containing heterocyclic group together with L. Examples of said heterocyclic group formed by Q together with L preferably include a pyrrole ring, a pyrrolidine ring, a pyrazole ring, an imidazole ring, an oxazole ring, a thiazole ring, a triazole ring, a thiadiazole ring, a pyridine ring, a quinoline ring, a pyridazine ring, a pyrimidine ring, a pyrazine ring, a triazine ring, an indole ring, a benzthiazole ring and a benzimidazole ring.]

In the formulas (1) and (2), preferable examples of $Y^1$ and $Y^3$ include a benzene ring, a furan ring, a pyrrole ring, thiophene ring, a pyrazole ring, an imidazole ring, a triazole ring, a thiadiazole ring, an oxazole ring, a thiazole ring, a pyran ring, a pyridine ring, a pyridazine ring, a pyrimidine ring, a pyrazine ring, a triazine ring, a naphthalene ring, a benzofuran ring, an indole ring, a benzothiophene ring, a benzimidazole ring, a benzothiazole ring, a benzoxazole ring, a purine ring, a quinoline ring, an iso-quinoline ring, a coumarin ring and a chromone ring.

In the formula (4), preferable examples of $Y^2$ include a 3H-pyrrole ring, an oxazole ring, an imidazole ring, a thiazole ring, a 3H-pyrrolidine ring, an oxazolidine ring, an imidazolidine ring, a thiazolidine ring, a 3H-indole ring, a benzoxazole ring, a benzimidazole ring, a benzthiazole ring, a quinoline ring, a pyridine ring and an indanedione ring.

These rings may form condensed rings together with other hydrocarbon rings (for example, a benzene ring) or heterocyclic rings (for example, a pyridine ring). Examples of substituents on said condensed rings include an alkyl group, an aryl group, a heterocyclic group, an acyl group, an amino group, a nitro group, a cyano group, an acylamino group, an alkoxy group, a hydroxy group, an alkoxycarbonyl group and a halogen atom, and these substituents may be further substituted with substituents.

In the formulas (3) through (31), $R^1$ through $R^7$ and $R^{10}$ through $R^{23}$ each represent a hydrogen atom and a monovalent substituent group. Examples of monovalent substituent group include a halogen atom (for example, a chlorine atom, a bromine atom, etc.), an alkyl group (for example, a methyl group, an ethyl group, an iso-propyl group, a hydroxyethyl group, a methoxyethyl group, a trifluoromethyl group, a t-butyl group, etc.), a cycloalkyl group (for example, a cyclopentyl group, a cyclohexyl group, etc.), an aralkyl group (for example, a benzyl group, a 2-phenethyl group, etc.), an aryl group (for example, a phenyl group, a naphthyl group, a p-tolyl group, a p-chlorophenyl group, etc.), an alkoxy group (for example, a methoxy group, an ethoxy group, an iso-propoxy group, a n-butoxy group, etc.), an aryloxy group (for example, a phenoxy group, etc.), a cyano group, an acylamino group (for example, an acetylamino group, a propionylamino group, etc.), an alkylthio group (for example, a methylthio group, an ethylthio group, a n-butylthio group, etc.), an arylthio group (for example, a phenylthio group, etc.), a sulfonylamino group (for example, a methanesulfonylamino group, a benzenesulfonylamino group, etc.), a ureido group (for example, a 3-methylureido group, a 3,3-dimethylureido group, a 1,3-dimethylureido group, etc.), a sulfamoylamino group (a dimethylsulfamoylamino group, etc.), a carbamoyl group (for example, a methylcarbamoyl group, an ethylcarbamoyl group, a dimethylcarbamoyl group, etc.), a sulfamoyl group (for example, an ethylsulfamoyl group, a dimethylsulfamoyl group, etc.), an alkoxycarbonyl group (for example, a methoxycarbonyl group, an ethoxycarbonyl group, etc.), an aryloxycarbonyl group (for example, a phenoxycarbonyl group, etc.), a sulfonyl group (for example, a methanesulfonyl group, a butanesulfonyl group, a phenylsulfonyl group, etc.), an acyl group (for example, an acetyl group, a propanoyl group, a butyloyl group, etc.), an amino group (for example, a methylamino group, an ethylamino group, a dimethylamino group, etc.), a cyano group, a hydroxy group, a nitro group, a nitroso group, an amineoxide (for example, a pyridineoxide group, etc.), an imido group (for example, phthalimido group, etc.), a disulfide group (for example, a benzenedisulfide group, a benzothiazolyl-2-disulfide group, etc.), a carboxyl group, a sulfo group, a heterocyclic group (for example, a pyridyl group, a benzimidazolyl group, a benzthiazolyl group, a benzoxazolyl group, etc.).

Exemplified dyes represented by the formulas (1), (2), (3) and (4) are shown below, but the dyes usable for the present invention are not limited thereto.

D-1

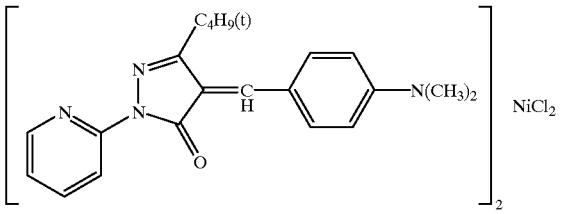

D-2

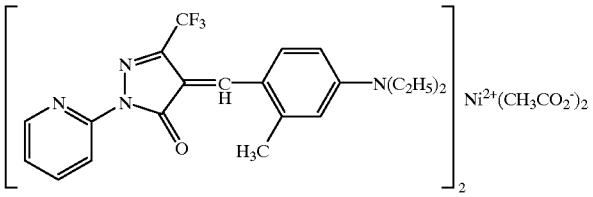

D-3

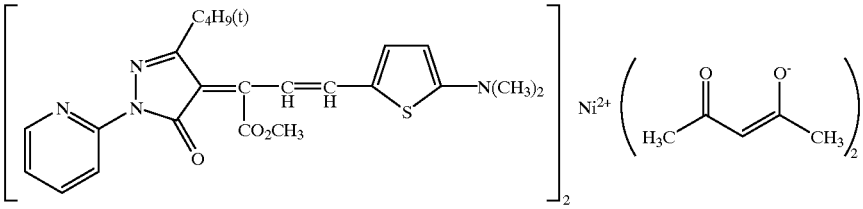

D-4

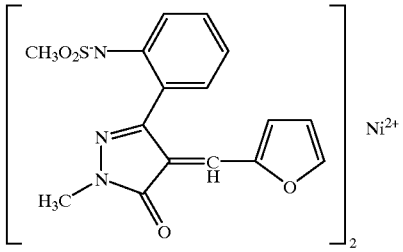

-continued
D-5
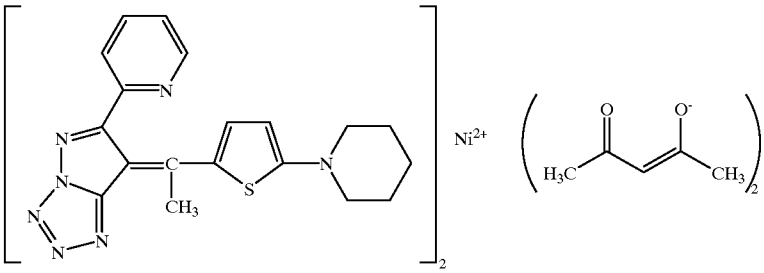
D-6
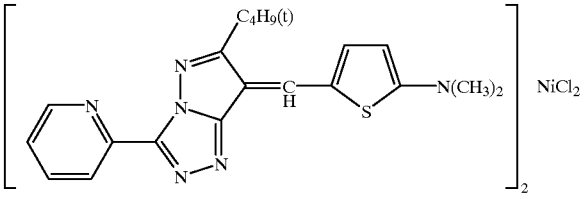
D-7
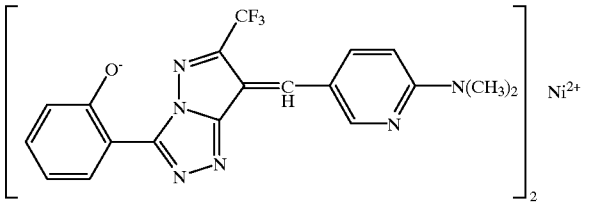
D-8
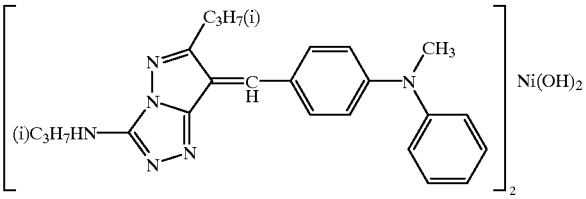
D-9
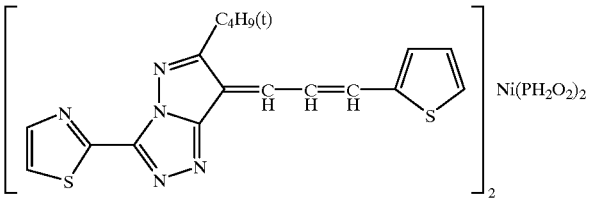
D-10
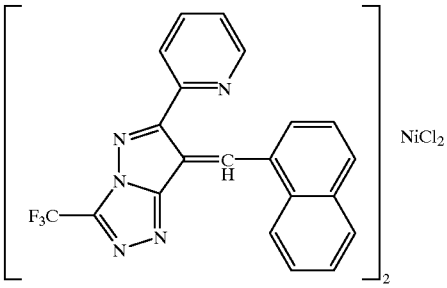
D-11
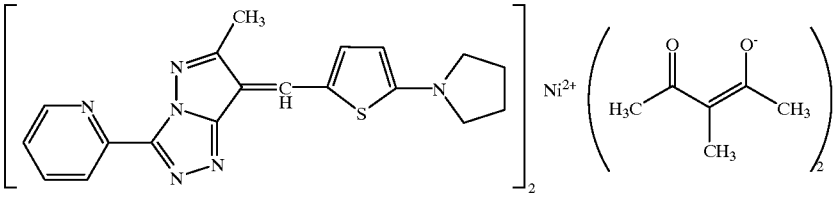
D-12
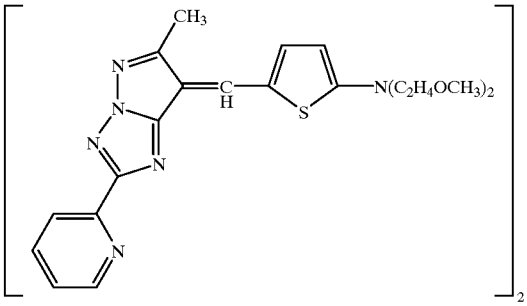
D-13
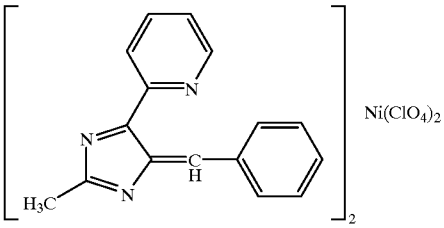

-continued
D-14
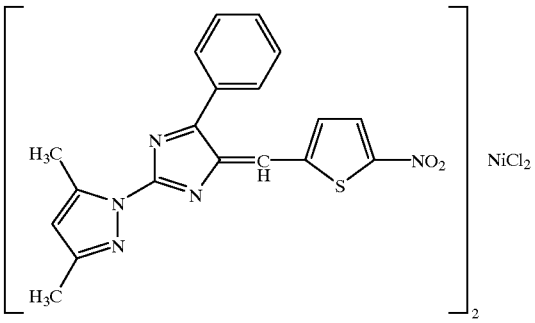
D-15
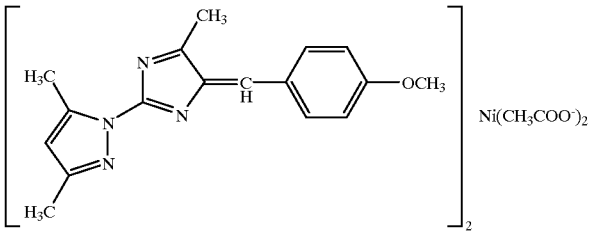
D-16
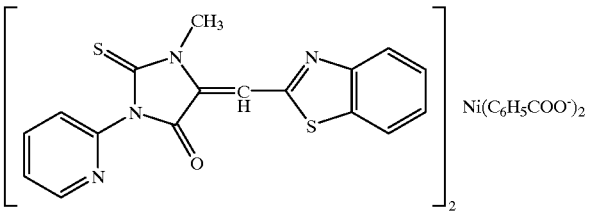
D-17
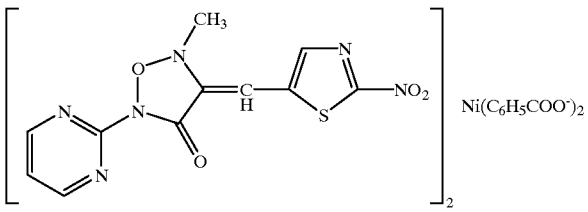
D-18
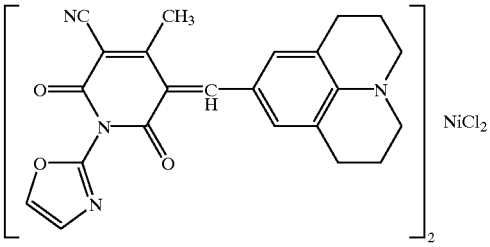
D-19
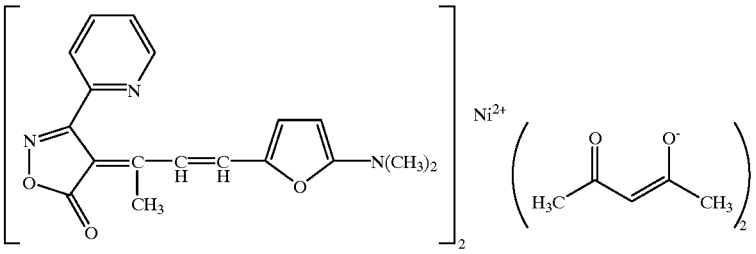
D-20
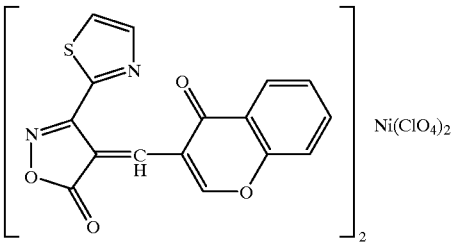
D-21
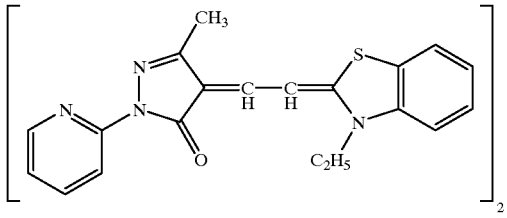
D-22
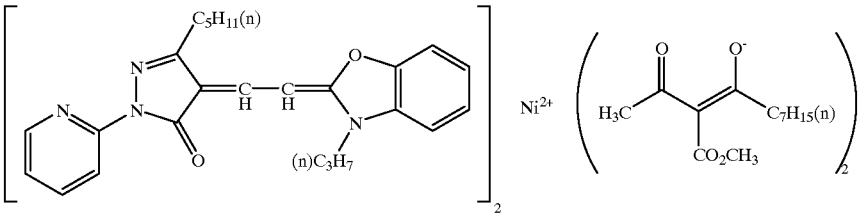

-continued
D-23
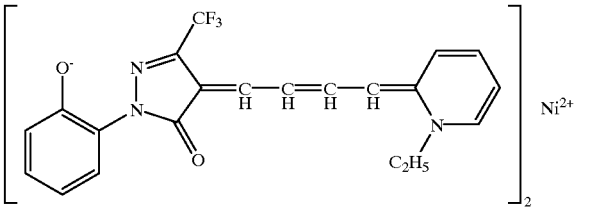
D-24
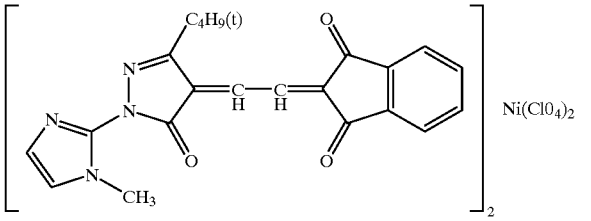
D-25
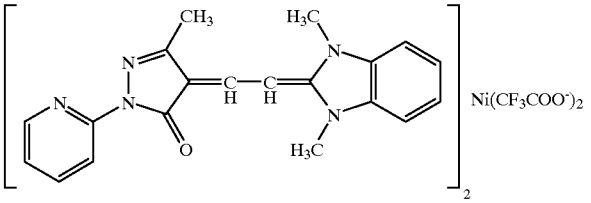
D-26
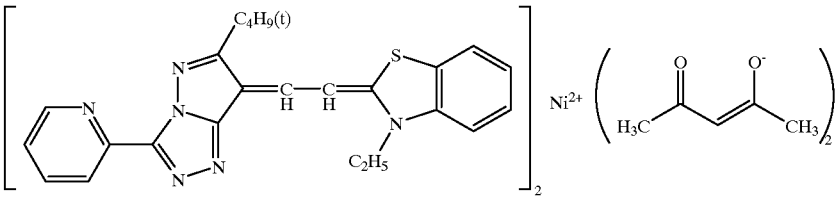
D-27
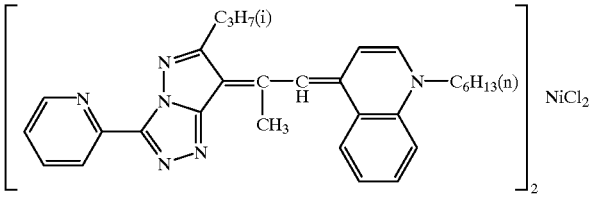
D-28
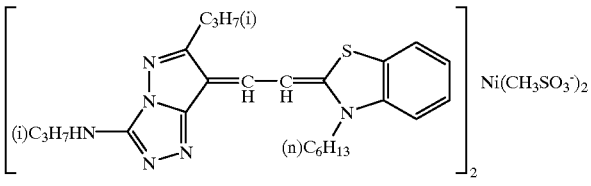
D-29
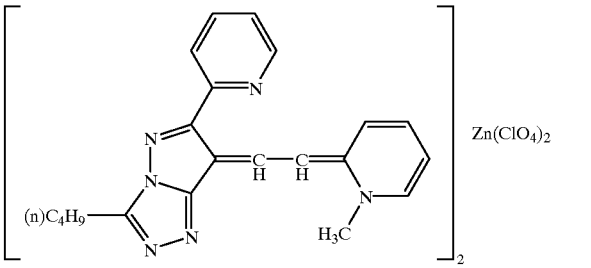
D-30
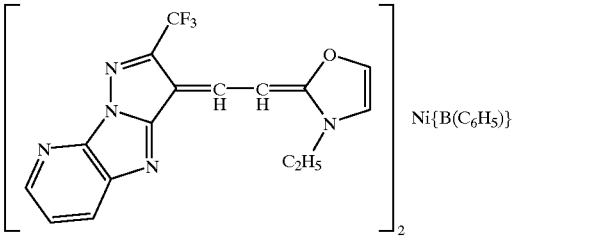
D-31
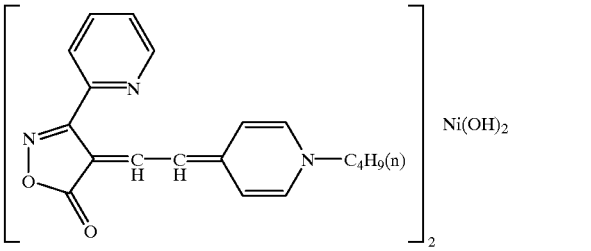
D-32
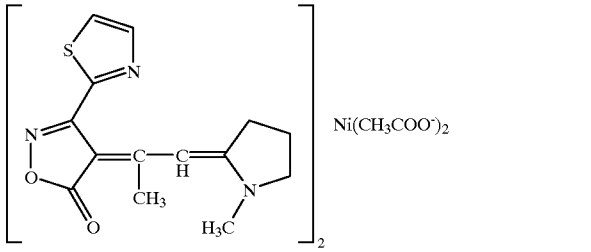

-continued
D-33
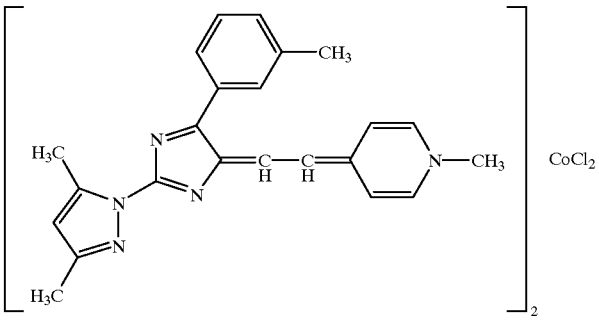
$CoCl_2$
D-34
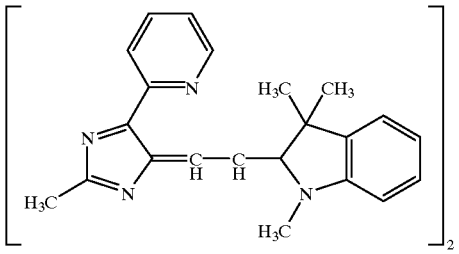
$Ni(C_6H_5SO_3^-)_2$
D-35
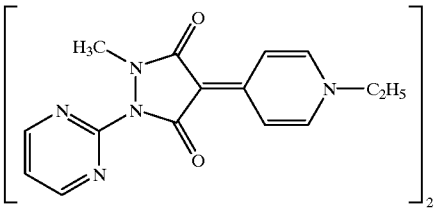
$NiI_2$
D-36
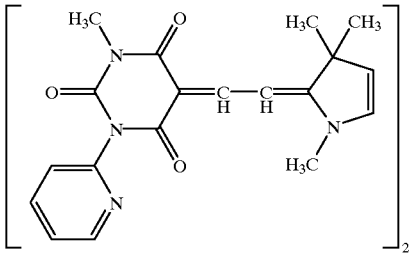
$Ni(ClO_4)_2$
D-37
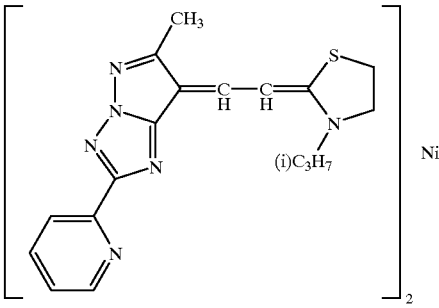
$NiCO_3$
D-38
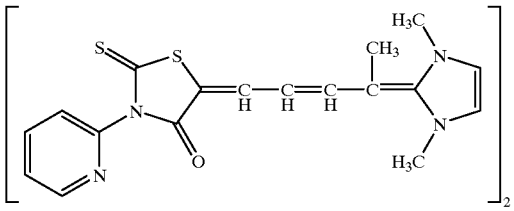
$NiCl_2$
D-39
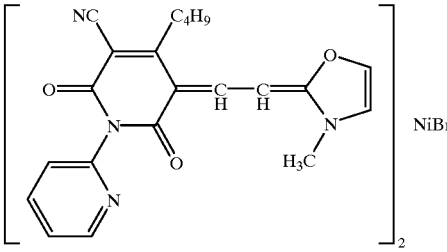
$NiBr_2$
D-40
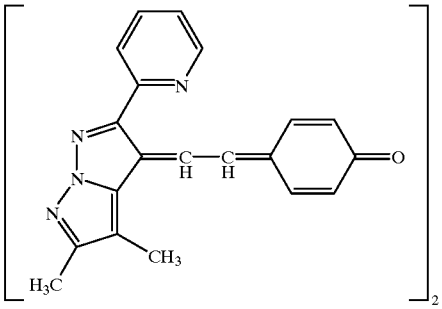
$Ni(C_6H_{13}COO^-)_2$
D-41
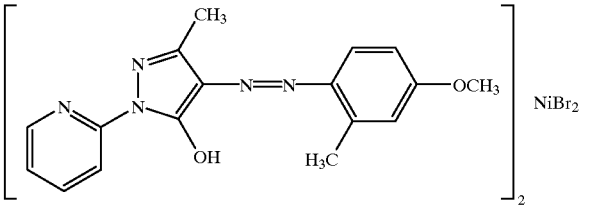
$NiBr_2$
D-42
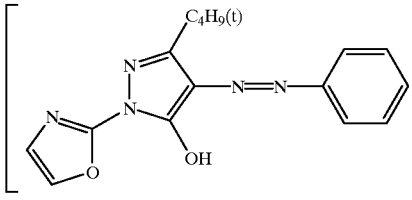
$CuCl_2$ -continued
D-43
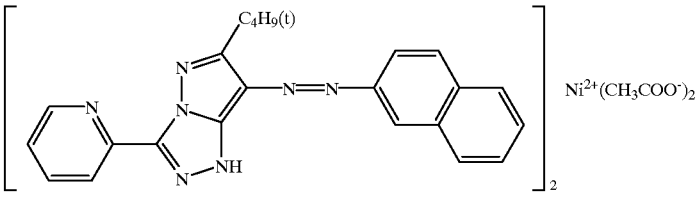
D-44
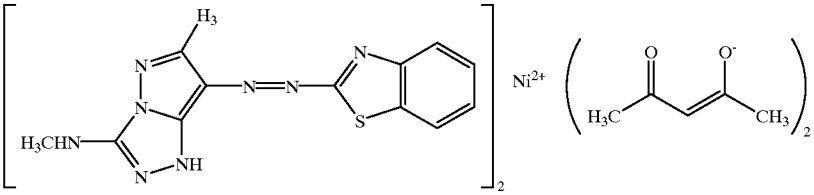
D-45
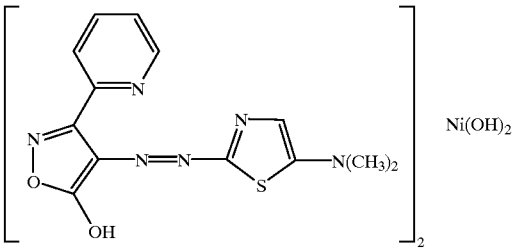
D-46
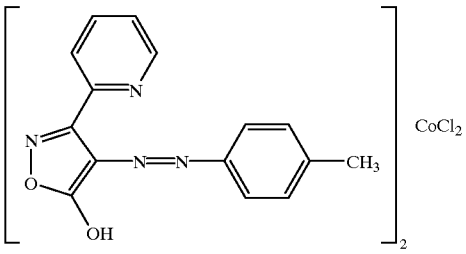
D-47
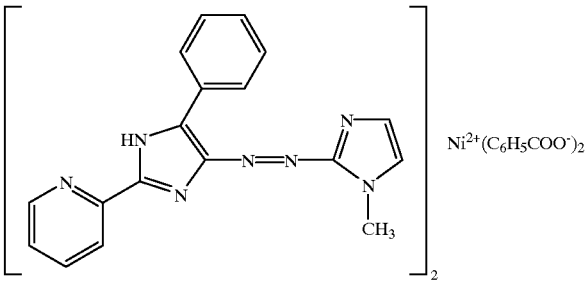
D-48
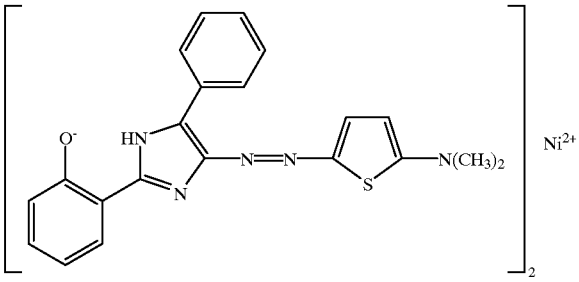
D-49
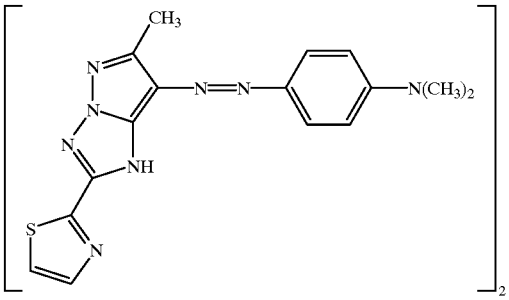
D-50
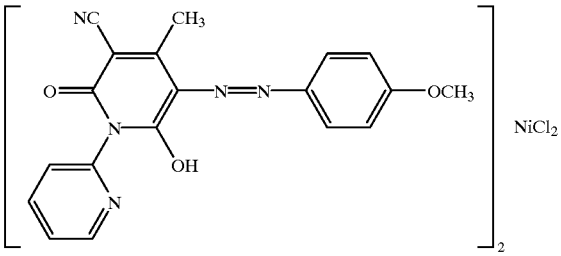
D-51
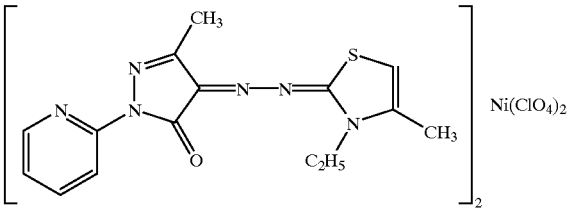
D-52
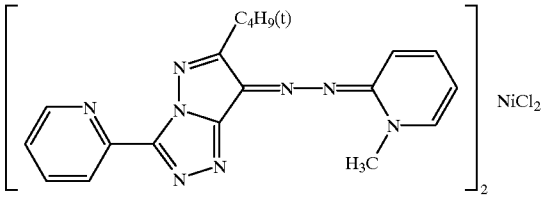

-continued
D-53
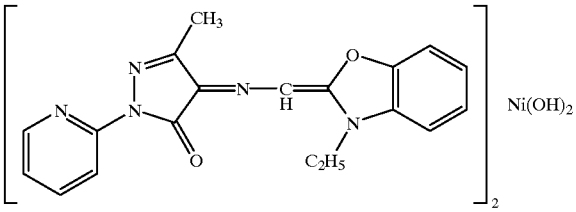
D-54
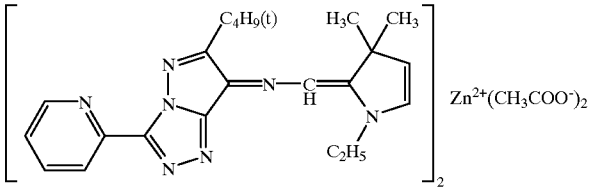
D-55
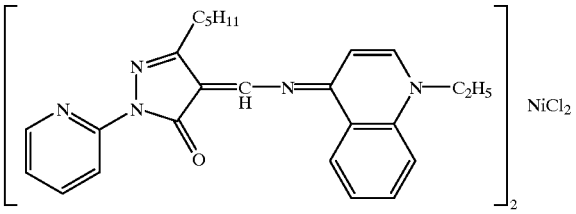
D-56
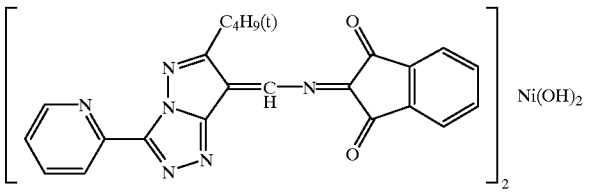
D-57
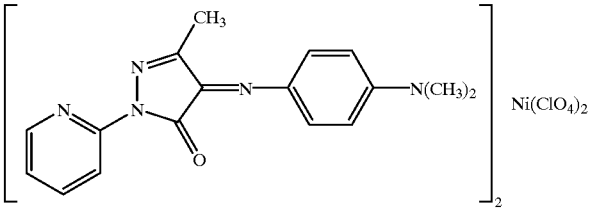
D-58
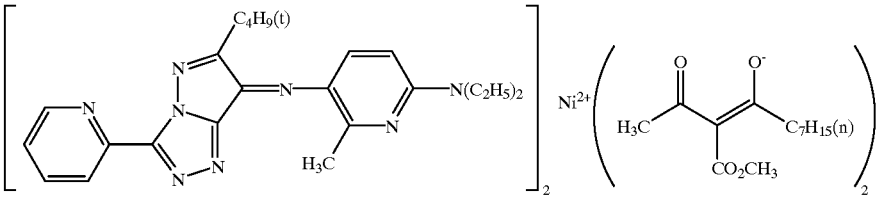
D-59
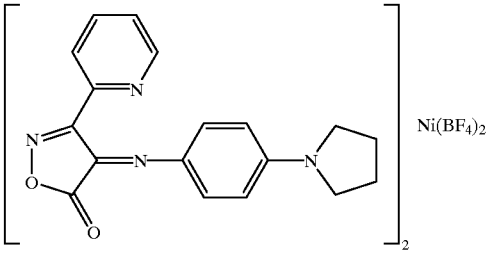
D-60
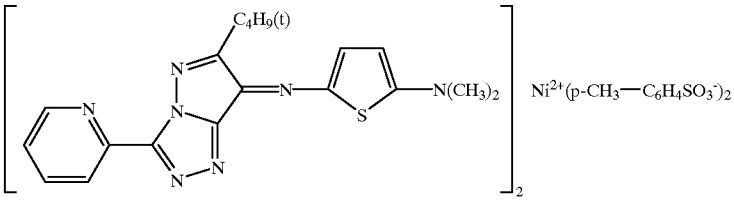

-continued
D-61
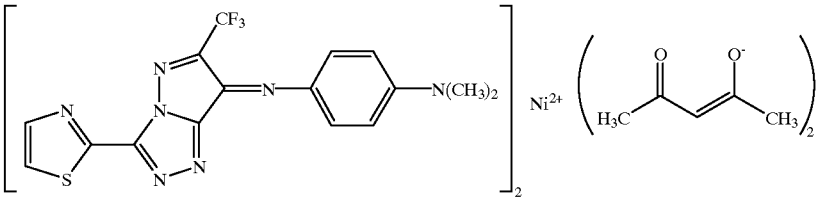
D-62
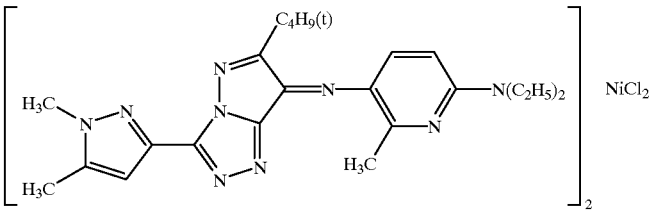
D-63
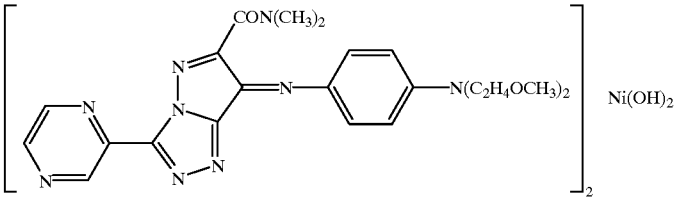
D-64
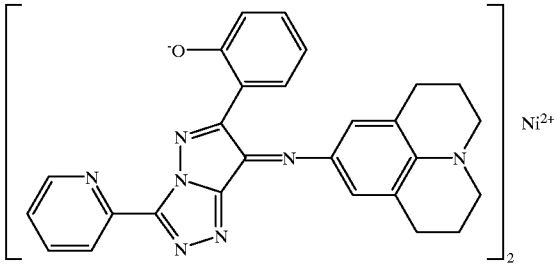
D-65
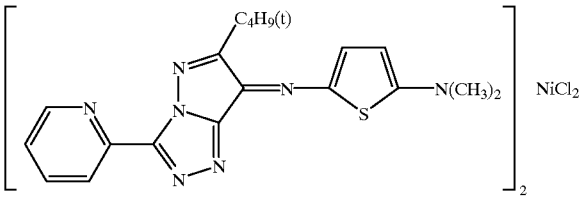
D-66
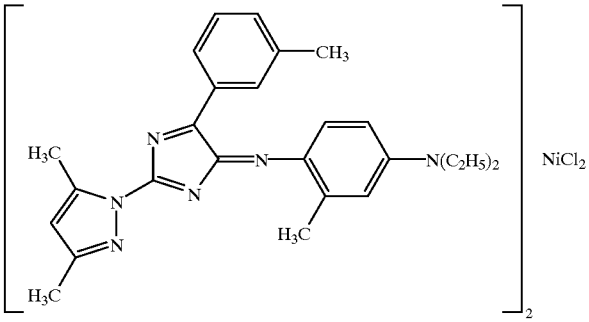
D-67
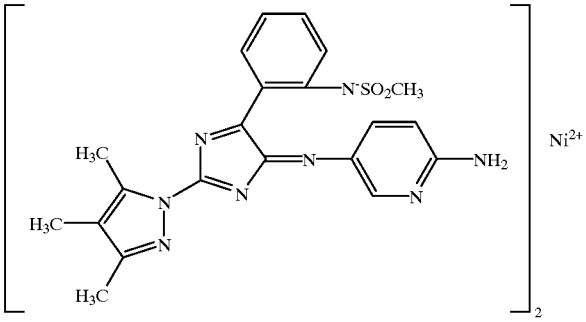
D-68
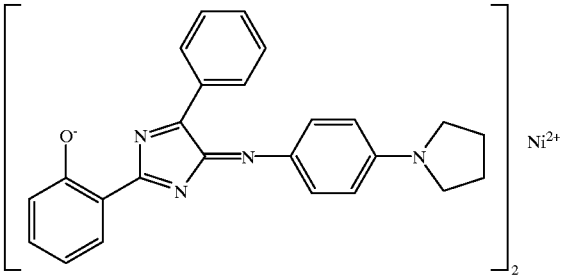

-continued

D-69

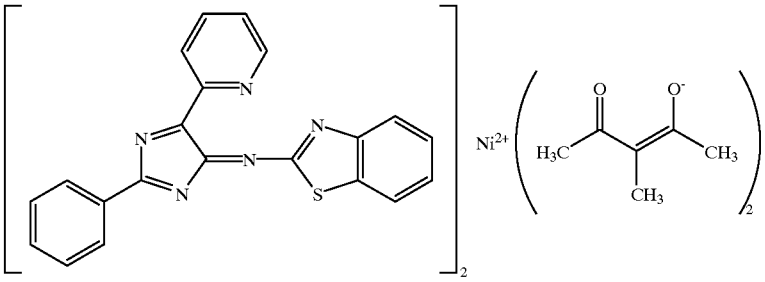

D-70

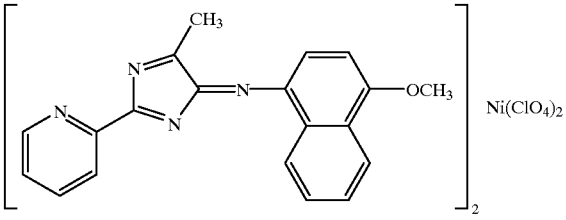

D-71

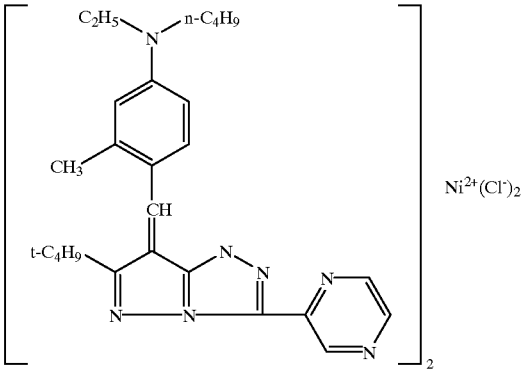

Synthesizing methods for obtaining dyes usable for the present invention are shown below.

Synthesizing Example 1 (for Synthesizing an Exemplified Dye D-6)

Synthesizing scheme

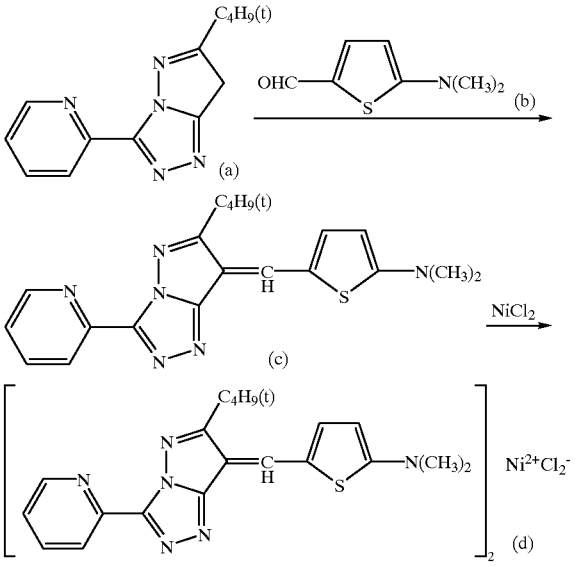

(1) 15 g of compound (a), 12 g of compound (b) and 12 ml of piperidine were added to 150 ml of toluene. The thus obtained solution was refluxed upon heating for 3 hours. After that, the solution was cooled down to room temperature to result in precipitated red crystals. The thus precipitated crystals were filtered and recrystallized from ethanol to obtain 9.0 g of red crystals [compound (c)]. The chemical structure of said compound (c) was confirmed by NMR spectrum and MASS spectrum. The absorption maximum of compound (c) was 538 nm in acetone.

(2) 2.0 g of said compound (c) was dissolved in 50 ml of methanol. To the thus obtained solution was added 0.62 g of nickel chloride 6 hydrate. After the solution was removed by distillation to leave crystals to which was added acetonitrile, the crystals were filtered, washed and dried. Thus, 2.0 g of the target metal complex dye [compound (d), being exemplified dye D-6] was obtained. The absorption maximum of the metal complex dye was 545 nm in acetone.

Synthesizing Example 2 (for Synthesizing an Exemplified Dye D-22)

Synthesizing scheme

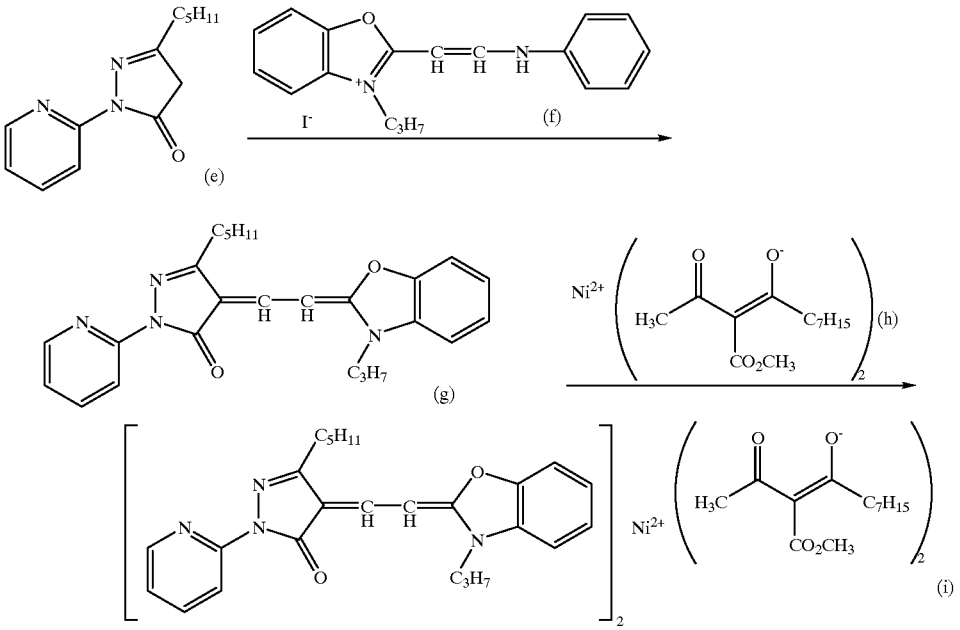

(1) 3.0 g of compound (e), 6.0 g of compound (f) and 3.0 ml of triethylamine were added to 30 ml of pyridine. After these compounds were dissolved upon heating, to the resulting solution was added 1.3 g of acetic anhydride. The thus obtained solution was stirred while heated at 80° C. for 1 hour. After that, the reaction solution was cooled down to room temperature and the reaction solution was poured slowly into a mixed aqueous solution of 35 ml of concentrated hydrochloric acid and 100 ml of ice water to result in precipitating crystals. Said precipitated crystals were collected by filtration, washed with distilled water and dispersed into 100 ml of ethylacetate. The thus obtained dispersion was stirred and neutralized with a saturated sodium hydrogencarbonate aqueous solution. The ethylacetate phase was washed with a saturated salt aqueous solution and dried with magnesium sulfate. After being dried, the ethylacetate phase was concentrated under reduced pressure employing a rotary evaporator to leave a residue which was recrystallized from acetonitrile to give 2.4 g of yellowish crystals [being compound (g)]. The chemical structure of the target compound (g) was confirmed by NMR spectrum and MASS spectrum. The absorption maximum of the compound (g) was 455 nm in acetone.

(2) 2.0 g of compound (g) was dissolved in 50 ml of methanol. To the thus obtained solution was added 1.3 g of the compound (h). After that, the solvent was removed by distillation to leave a residue to which was added acetonitrile to result in precipitated crystals, which were separated by filtration, washed and dried. Thus, 2.0 g of the target metal complex dye [compound (i), being exemplified dye D-22] was obtained. The absorption maximum of the metal complex dye was 462 nm in acetone.

The content of the metal complex dye of the present invention in the toner is 0.01 to 15 parts by weight, preferably 1.0 to 10 parts by weight, based on the weight of binder resin.

Representative preparing method of the toner produced in the polymerization toner manufacturing method according to the present invention will now be detailed.

Non-spherical particles are produced by fusing fine binder particles while heating, and the toner made from these non-spherical particles refers to the toner produced in the polymerization toner manufacturing method of the present invention and said toner will now be explained.

When the non-spherical particles are effectively produced through the association fusion of a plurality of fine binder particles, said non-spherical particles are treated with a coagulant, the concentration of which is more than the critical coagulation concentration, as well as with an infinitely water-soluble organic solvent. Thus, an objective of the present invention can be attained more effectively.

The fine binder particles used in the present invention are generally produced through emulsion polymerization, suspension polymerization, dispersion polymerization, precipitation polymerization or interface polymerization. Of these, resin latex, which is produced in an emulsion polymerization, suspension polymerization or dispersion polymerization, is preferably used.

The colorant, and components other than the binder, necessary for producing a color toner for developing an electrostatic image may be contained in the binder resin during synthesizing of said binder resin. In addition, after said binder resin is produced, these colorants and other components are dispersed, and then the thus obtained dispersion may be mixed with said binder resin when the desired particle size is adjusted by fusion during heating.

For example, the colorant is dispersed in the presence of a surfactant, the concentration of which is more than the critical micelle concentration (CMC), after that the concentration of the surfactant contained in the above obtained colorant dispersing solution was diluted to less than CMC, and to the thus obtained solution were added a monomer capable of radical polymerization and a radical polymerization initiator to conduct polymerization reaction at a desired temperature to obtain fine binder particles.

Particle size of the fine binder particles (resin latex) may be arbitrarily chosen, if said particle size is less than the intended particle size of the toner particles, however, in general, said particle size is preferably between 0.01 and 10 μm, more preferably between 0.05 and 0.5 μm. Said particle size can be measured employing a light scattering electrophoresis particle diameter measurement apparatus (ELS-800, manufactured by Otsuka Denshi Kogyo Co.). Preferable mean equivalent spherical diameter of the toner produced according to the present inventive polymerization toner manufacturing method is between 2 and 15 μm, more preferably is between 4 and 9 μm. Said mean equivalent spherical diameter of the toner can be measured employing a coulter counter (produced by Coulter Electronics Co., Ltd.).

Since a small amount of fine silica powder, or the like, is usually added to adhere on the surface of colorant particles, the colorant particles containing such external additives on its surface refer to a toner for developing an electrostatic image, and on the other hand, particles obtained by fusion upon heating prior to adding such external additives, occasionally refer to non-spherical particles, because the method according to the present invention by fusion upon heating produces said non-spherical particles.

The present invention will be further detailed below.

[Fine Binder Particles]

The fine binder particles are usually produced through emulsion polymerization, suspension polymerization, dispersion polymerization, precipitation polymerization or interface polymerization. Of these, as mentioned above, polymerized particles, which are produced in the emulsion polymerization, suspension polymerization or dispersion polymerization, are preferably used.

Tg (glass transition temperature) of the fine binder particles is preferably between −10 and 120° C., and is more preferably between 0 and 90° C. The softening point of said fine binder particles is between 80 and 220° C. As long as the Tg and the softening point of said fine binder particles are within the same range as mentioned above, any kind and any composition of monomers which constitute a copolymer may be employed. The weight average molecular weight of the fine binder particles is preferably between 2,000 and 1,000,000, and is more preferably between 8,000 and 500,000. Further, with respect to molecular distribution, the ratio of weight average molecular weight to number average molecular weight (abbreviated as Mw/Mn) is preferably between 1.5 and 100, and is more preferably between 1.8 and 50.

[Monomer]

As a monomer capable of polymerization used for producing the binder resin employed in the present invention, a hydrophobic monomer is a necessary constitution component, if necessary, a monomer capable of forming cross linking is available. Further, as mentioned below, said binder resin is preferably produced through reaction of at least one of a monomer having an acidic polar group or a monomer having a basic polar group.

(1) Hydrophobic Monomer

As a hydrophobic monomer constituting a monomer composition, any known monomer may be used without limitation. Further, not only one kind of monomer may be used, but also two kinds or more of monomers may be used in combination to satisfy required characteristics.

Concretely, monovinyl aromatic type monomer, (meth) acrylic acid type monomer, (meth)acrylic acid ester type monomer, vinylester type monomer, vinylether type monomer, mono-olefin type monomer, di-olefin type monomer, halogenated olefin type monomer and the like can be cited.

Examples of the monovinyl aromatic type monomer include a styrene type monomer such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene and its derivatives.

Examples of the (meth)acrylic acid type monomer and (meth)acrylic acid ester type monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxy ethyl acrylate, γ-amino propyl acrylate, stearyl methacrylate, di-methylaminoethyl methacrylate and di-ethylaminoethyl methacrylate, etc.

Examples of the vinylester type monomer include vinyl acetate, vinyl propionate and vinyl benzoate, etc.

Examples of the vinylether type monomer include vinylmethylether, vinylethylether, vinyliso-butylether, vinylphenylether, etc.

Examples of the mono-olefin type monomer include ethylene, propylene, iso-butylene, 1-butene, 1-pentene, 4-methyl-1-pentene, etc.

Examples of di-olefin type monomer include butadiene, isoprene, chloroprene, etc.

(2) Monomer Capable of Forming Cross Linking

In order to improve the chracteristics of the fine binder particles, a monomer capable of forming cross linking may be added. Example of the monomer capable of forming cross linking include a monomer having at least two unsaturated bonds such as di-vinylbenzene, di-vinylnaphthalene, di-vinylether, di-ethyleneglycol methacrylate, ethyleneglycol di-methacrylate, polyethyleneglycol di-methacrylate, di-allyl phthalate, etc.

(3) Monomer Having an Acidic Polar Group

As the monomer having an acidic polar group, (i) an α,β-ethylenically unsaturated compound containing a carboxylic acid group (—COOH) and (ii) an α,β-ethylenically unsaturated compound containing a sulfonic acid group (—$SO_3H$) can be cited.

Examples of said α,β-ethylenically unsaturated compound containing the carboxylic acid group (—COOH) of (i) include acrylic acid, methacrylic acid, fumaric acid, maleic acid, itaconic acid, cinnamic acid, maleic acid mono-butyl ester, maleic acid mono-octyl ester and their Na salts, Zn salts, etc.

Examples of said α,β-ethylenically unsaturated compound containing the sulfonic acid group (—$SO_3H$) of (ii) include sulfonated styrene and its Na salt, allylsulfo succinic acid, allylsulfo succinic acid octyl ester and their Na salts.

(4) Monomer Having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quarternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quarternary salt. Of these, (meth)acrylic acid ester obtained by reacting (meth)acrylic acid with the aliphatic alcohol having the amino group or the quarternary ammonium group is preferred.

Examples of (meth)acrylic acid ester obtained by reacting (meth)acrylic acid with the aliphatic alcohol having the amino group or the quarternary ammonium group of (i) include dimethylaminoethylacrylate, dimethylaminoethylmethacrylate, diethylaminoethylacrylate, diethylaminoethylmethacrylate, quarternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrlamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quarternary salt of (iv) include N,N-di-allyl-methylammonium chloride, N,N-di-allyl-ethylammonium chloride, etc.

[Chain Transfer Agent]

A chain transfer agent which is usually used can be used for the purpose of adjusting a molecular weight.

Examples of the chain transfer agent include, for example, mercaptan groups such as octyl mercaptan, dodecyl mercaptan, tert-dodecyl mercaptan, etc.

[Polymerization Initiator]

A radical polymerization initiator can be conveniently used, if it is water-soluble. Examples of the radical polymerization initiator include persulfate (potassium persulfate, ammonium persulfate), azo type compound (4,4'-azo-bis-4-cyanovaleric acid and its salt, 2,2'-azo-bis-2-aminopropane salt), hydrogen peroxide and peroxide compound such as benzoylperoxide.

Further, the above-mentioned radical polymerization initiator, if necessary, can be combined with a reducing agent to be useful as a redox type initiator. Said redox type initiator can cause enhancing polymerization activity to result in lowering polymerization reaction temperature, as well as shortening polymerization time.

With respect to the polymerization temperature, any polymerization temperature at which radical generation occurs from said radical polymerization initiator can be employed. In general, the polymerization temperature between 50 and 80° C. is employed. When the combination of hydrogen-peroxide and reducing agent (ascorbic acid, etc.) is employed as a polymerization initiator, polymerization reaction can occur at room temperature or temperature close to the room temperature.

[Surfactant]

Examples of surfactant include sulfonate (sodium dodecylbenzenesulfonate, sodium arylalkyl polyethersulfonate, sodium 3,3-di-sulfone-di-phenylurea-4,4-diazo-bis-amino-8-naphthol-6-sulfonate, o-carboxybenzene-azo-dimethylaniline, sodium 2,2,5,5-tetramethyl-triphenylmethane-4,4-diazo-bis-β-naphthol-6-sulfonate, etc.), sulfuric acid ester salt (dodecylsulfuric acid sodium salt, tetradecylsulfuric acid sodium salt, pentadecylsulfuric acid sodium salt, octylsulfuric acid sodium salt, etc.), fatty acid salt (sodium oleate, sodium laurate, sodium caprate, sodium caproate, potassium stearate, calcium oleate, etc.).

[Coagulants]

The coagulants employed in the present invention are preferably selected from metallic salts.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application. Generally, the critical coagulation concentration (coagulation value or coagulation point) of divalent metallic salts is less than that of monovalent metallic salts. Furthermore, the critical coagulation concentration of trivalent metallic salts is lowered.

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The concentration of coagulant may be not less than the critical coagulation concentration. However, the amount of the added coagulant is preferably at least 1.2 times of the critical coagulation concentration, and more preferably 1.5 times.

[Infinitely Water-soluble Organic Solvents]

The "infinitely water-soluble organic solvent" is a solvent which can form uniformly a mixed solution with water at any mixing-ratio, and those which do not dissolve fine polymer particles are preferred. Specific examples include alcohols such as methanol, ethanol, propanol, isopropanol, t-butanol, methoxyethanol, ethoxyethanol, butoxyethanol, etc., nitrites such as acetonitrile, etc., dioxane, etc. Specifically preferable ones are alcohol derivatives, and of these, 2-propanol is the most preferable. The mixing ratio of water to the above-mentioned solvent is preferably 9:1 to 1:1 by weight.

An infinitely water-soluble organic solvent is suitably selected from the range of 1 to 300 percent to the fine polymer particle dispersion to which a coagulant has been added.

[Solid Components]

As components necessary for preparing a toner for developing an electrostatic image, can be cited a releasing agent, an electrostatic charge regulating agent other than the above-mentioned colorant. These agents may be used singly or in combination.

These agents are added during preparing the fine binder particles or after that, and additional amount of these agents is 0.1 to 25 wt % to the amount of the fine binder particles.

[Non-spherical Shape Forming Reaction]

Non-spherical particles are prepared by associating a plurality of fine polymer particles. In this case, a colorant in a dispersed form may be added at the time when a plurality of the fine binder particles are associated and is allowed to combine with the particles during the association.

The average particle diameter as well as particle distribution of these non-spherical particles are determined by coagulant concentration, additional concentration of an infinitely water-soluble organic solvent, and further, by the degree of dissociation of the monomer unit having an ionic dissociation group of the fine binder particles. For example, when the additional concentration of an infinitely water-soluble organic solvent, temperature, and the degree of dissociation of the monomer unit having an ionic dissociation group of polymer particles are kept constant, the particle diameter generally increases with an increase in the coagulant concentration, and it decreases with a decrease in the coagulant concentration. In the same manner, when the coagulant concentration and degree of dissociation of the monomer unit having an ionic dissociation group of polymer particles are kept constant, the particle diameter increases with an increase in the additional concentration of an infinitely water-soluble organic solvent, while it decreases with a decease in the additional concentration. Furthermore, when the degree of dissociation of the monomer unit having an ionic dissociation group of the fine binder particles is varied, the particle diameter decreases with an increase in the degree of dissociation, and the particle diameter of formed particles increases with a decrease in the degree of dissociation.

Namely, the desired particle diameter may be obtained by appropriately changing the three factors above-mentioned. Furthermore, particles with a markedly narrow particle distribution may be obtained by utilizing the function of these three factors.

[Production Method]

In the present inventive polymerization toner manufacturing method, typically, at first, the fine binder particles are prepared, and when said fine binder particles are associated and fused, a required amount of a metallic salt or an aqueous metallic salt solution is added into the fine binder particles dispersion. In addition, processes are basically such that an infinitely water-soluble organic solvent is added, and heating is carried out at temperature of −5 to +50° C. of the Tg of the fine polymer particles. However, the addition sequence of each additive is not particularly limited, nor is the production method limited to one described above.

[Producing Method]

(In the Case of Emulsion Polymerization Method)

As mentioned above, the following process is generally employed.

(Emulsion polymerization process)→(Association fusion process)→(Washing process)→(Drying process)→(Pulverizing process)

Almost the same process as mentioned above is employed in suspension polymerization process or dispersion polymerization process mentioned below (association fusion process may be occasionally eliminated).

An apparatus used in the present invention is not specifically limited. Namely, with respect to a reaction vessel employed in polymerization reaction and associating non-spherical particles, the reaction vessel is not specified, however, a cylindrical or spherical reaction vessel is preferred.

The shape of a stirring blade is not specified, however, for example, can be cited an anchor blade, a turbine blade, a Pfaudler impeller, a Macs blend blade, a full zone blade, a paddle blade, a helical blade, a bull margin blade and the like.

(In the Case of Suspension Polymerization Method)

As can be seen in JP-A No. 9-80812, etc., various kinds of homogenizers, mixers and stirrers can be employed in the suspension polymerization, and additionally the same apparatus as employed for the above-mentioned emulsion polymerization can be employed.

(In the Case of Dispersion Polymerization)

As can be seen in JP-A No. 8-320594, etc., various kinds of homogenizers, mixers and stirrers can be employed in the dispersion polymerization, and additionally the same apparatus as employed for the above-mentioned emulsion polymerization can be employed.

[Colorant]

The colorant used in the present invention can be used singly or in combination of two or more kinds in accordance with the desired purpose. Further, an additional amount of the colorant or pigment is mostly 2 to 20 wt % to the amount of the binder.

Dispersion of the colorant is preferably conducted in water phase at the surfactant concentration of not less than CMC. As a dispersion method, can be employed a mechanical stirrer such as a sand grinder, a sonic homogenizer such as an ultrasonic homogenizer, and a pressure homogenizer such as a Manton-Gaulin homogenizer.

[Water-soluble Organic Solvent Used in Dispersing Process]

As a water-soluble organic solvent used in the dispersion process, the solvent having S.P. value [solubility parameter, described in Polymer Handbook, IV-340 (1975)] of not less than 19.0 $J/m^3$ is preferred. For example, can be cited methanol (S.P. value=29.7 $J/m^3$), ethanol (S.P. value=26.0 $J/m^3$), iso-propanol (S.P. value=23.5 $J/m^3$), acetone (S.P. value=20.3 $J/m^3$) and methy ethyl ketone (S.P. value=19.0 $J/m^3$).

[Surface Improvement Agent]

As a surface improvement agent for the colorant, known surface improvement agent can be used. The preferred exemplified surface improvement agents include silane compounds, titanium compounds, aluminium compounds and the like.

Examples of the silane compound include alkoxysilane such as tri-methyl-methoxysilane, phenyl-tri-methoxysilane, methylphenyl-di-methoxysilane and di-phenyl-di-methoxysilane, silizane such as hexamethyl-disilozane, γ-chloropropyl-tri-methoxysilane, vinyl-tri-chlorosilane, vinyl-tri-methoxysilane, vinyl-tri-ethoxysilane, γ-methacryloxypropyl-tri-methoxysilane, γ-glycidoxypropyl-tri-methoxysilane, γ-mercaptopropyl-tri-methoxysilane, γ-aminopropyl-tri-ethoxysilane and γ-ureidopropyl-tri-ethoxysilane, etc.

Examples of the titanium compound include the trade names of Plane Act TTS, Plane Act 9S, Plane Act 38S, Plane Act 41B, Plane Act 46B, Plane Act 55, Plane Act 138S, Plane Act 238S (all of them are produced by Ajinomoto Co., Ltd.) which are available on the market; and trade names of A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP (all of them are produced by Nihon Soda Co., Ltd.) which are available on the market.

An example of aluminium compound includes Plane Act AL-M (produced by Ajinomoto Co., Ltd.).

The concentration of these surface improvement agent is preferably 0.01 to 20 wt % to the amount of the colorant, more preferably 1 to 15 wt %.

[Electrostatic Image Developing Toner]

When non-spherical particles are employed as the toner for developing an electrostatic image, said toner must contain some components which are necessary for maintaining characteristics of the toner. Examples of the above-mentioned components include an electric charge controlling agent, a releasing agent, etc.

Further, in order to improve fluidity and electrification property of the toner, an after-additive (referred to as an external additive) and a slipping agent are available.

[Releasing Agent]

Known releasing agent can be used. In general, a poly olefin type compound can be used. Examples of said poly olefin type compound include low molecular polyethylene, acid-treated polyethylene and polypropylene, acid modified polyethylene and polypropylene, etc.

[Electric Charge Controlling Agent]

Known electric charge controlling agent can be used. However, when monomers having a polar group are co-polymerized on the surface of the fine binder particles, said electric charge controlling agent is not necessarily employed. Here, said polar group represents a group having negative or positive electrification such as a carboxy group, a sulfonic acid group, a sulfuric acid ester group, an amino group, an ammonium group, etc.

With respect to said electric charge controlling agent, examples of positive electrification compounds include nigrosine type electron donating dye, naphthene acid or higher fatty acid metal salt, alkoxylated amine, quarternary ammonium salt, alkylamide, metal complex, pigment, fluorine treated surfactant, etc.; and examples of negative electrification compounds include electron accepting type organic complex, chlorinated paraffin, chlorinated polyester, sulfonylamine of copper phthalocyanine, etc.

[External Additives]

As the external additives, there are a fluidizing agent, and fine particles of a charge controlling agent and a slipping agent. Examples of said fluidizing agent include fine inorganic particles such as hydrophobic silica, titanium oxide, alumina and additionally their sulfides, nitrides and silicon carbide, etc. Examples of said electric charge controlling agent include polyfluorinated vinylidene, polystyrene powder, polymethylmethacrylate powder and fine polyethylene particles, etc.

[Slipping Agent]

Examples of the slipping agent include higher fatty acid metal salts such as stearic acid metal salts of cadmium, barium, nickel, cobalt, strontium, copper, magnesium, calcium; oleic acid metal salts of zinc, manganese, iron, cobalt, copper, lead, magnesium; palmitic acid metal salts of zinc, cobalt, copper, magnesium, silicon, calcium; linoleic acid metal salts of zinc, cobalt, calcium; ricinoleic acid metal salts of zinc, cadmium; lead caprate; lead caproate. These metal salts are added in accordance with necessity.

[Developer]

A developer used in the present invention may be a one-component developer or a two-component developer, however, the two-component developer is preferred. When the one-component developer is employed, the aforesaid toner is used as it is, as a non-magnetic developer. However, a magnetic one-component developer containing magnetic particles of 0.1 to 5 $\mu$m particle size in the toner particles is usually employed. The magnetic particles are contained in the non-spherical particles in the same manner as employed for containing the colorant in the non-spherical particles.

However, a two-component developer using a developing carrier is more widely employed. In this case, as carrier magnetic particles, known materials such as metals including iron, ferrite, magnetite and the like; alloys made from such metals and metals of aluminium, lead and the like. $Fe_2O_3$ containing at least one of $Li_2O$, MgO and MnO is specifically preferred. The volume average particle size of the above-mentioned magnetic particles is preferably between 15 and 100 $\mu$m, more preferably between 25 and 60 $\mu$m.

Measurement of the volume average particle size of the carrier is conducted by laser diffraction type particle distribution measurement apparatus using wet type homogenizer (HELOS, produced by Sympatec Co., Ltd.).

The carrier is preferably further coated with a resin. The resin components are not limited to be used and examples of the resin components include olefin type resin, styrene type resin, styrene/acryl type resin, silicone type resin, ester type resin or fluorine containing polymer type resin, etc.

Furthermore, the specific resistance of the carrier is specifically between $10^5$ and $10^{14}$ Ω·cm. When the specific resistance is less than $10^5$ Ω·cm, charge injection occasionally occurs, on the other hand, when the specific resistance is more than $10^{14}$ Ω·cm, developing property is inferior because charge dose not reach the surface of a developing layer (tip of brisle of developer).

In the present invention, the magnetization of the carrier is preferably between 20 and 60 emu/cm$^3$, specifically preferably between 30 and 50 emu/cm$^3$. When the magnetization is less than 20 emu/cm$^3$, the adherence of the carrier takes place at an unexposed portion of photo receptor drum, and when the magnetization is more than 60 emu/cm$^3$, forming a soft and uniform developing layer on a developing screen is difficult.

EXAMPLES

The present invention will now be detailed below with reference to specific Examples, but the present invention is not limited thereto. Further, parts herein are by weight, unless otherwise specified.

Non-spherical Particles 1

[Metal Complex Dye Dispersion: Colorant Dispersion Process]

Put into a resin vessel having 20-liter internal volume, were 0.90 kg of Adeka Hope LS-90 (n-dodecylsulfuric acid sodium salt, produced by Asahi Denka Co.), 10 l of deionized water and 0.5 l of iso-propanol (produced by Kanto Chemical Co., S.P. value; 23.5 J/m$^3$). The thus obtained solution was stirred to dissolve the ingredients. To the above-obtained mixture was added slowly 1.2 kg of an exemplified compound D-3 (cyan dye) while stirring. After that, the thus obtained solution was stirred for an additional hour.

The entire volume of the above obtained solution was continuously dispersed for 20 hours under the following conditions employing a medium type homogenizer, Dispermat SL (produced by Getzmann Co., SL-C12 type).

(Dispersion Conditions)

Utilized beads: 0.3 mm zirconia beads

Filling up ratio of beads: 80 wt %

Rotational rate: 5000 rpm

Utilized vessel: 125 ml

Solution temperature: 28–30° C.

Method for transferring solution: circulation

Transferring speed of solution: 0.05 l/min.

The dispersed particle diameter of the above-obtained dispersion was measured employing a light scattering electrophoresis particle diameter measurement apparatus (ELS-800, manufactured by Otsuka Denshi Kogyo Co.), and consequently the diameter was found to be 122 nm (average diameter obtained from 5 measurements). Further, the solid components content of the above-mentioned dispersion was found to be 16.6 wt/wt % by measuring after said dispersion was left undisturbed to dry. Thus, colorant dispersing solution 1 was obtained.

[Polymerization of Latex A: Emulsion Polymerization Process/Lower Molecular Component]

Put into a 10-liter stainless steel pot were 0.55 kg of dodecylbenzenesulfonic acid sodium salt (produced by Kanto Chemical Co.) and 4.0 l of deionized pure water. The thus obtained solution was stirred at room temperature to dissolve the ingredients. Thus, anionic surfactant solution A was obtained.

Put into a 10-liter stainless steel pot were 0.14 kg of Newcol 565C (produced by Nihon Nyukazai Co.) and 4.0 l of deionized pure water. The thus obtained solution was stirred at room temperature to more quickly dissolve the ingredients. Thus, nonionic surfactant solution B was obtained.

Put into a 20-liter enameled pot were added 223.8 g of potassium peroxodisulfate (produced by Kanto Chemical Co.) and 12.0 l of deionized pure water. The thus obtained solution was stirred at room temperature to dissolve the ingredients. Thus, initiator solution C was obtained.

Put into a 100-liter glass lined reaction vessel equipped with a temperature sensor, a cooling pipe, and a nitrogen gas introducing pipe, were 3.41 kg of WAX emulsion (polypropylene, with a number average molecular weight of 3000, is heated up to a temperature above its melting point and then dispersed to be emulsified: solid component content was 29.9%), an anion surfactant solution A, and a nonion surfactant solution B, and the resulting mixture was stirred, to which was added 44.0 l of deionized water. To the thus obtained solution was added a mixture consisting of 12.1 kg of styrene, 2.88 kg of n-butyl acrylate, 1.04 kg of methacrylic acid and 548 g of TDM (t-dodecyl mercaptan).

Subsequently, the thus obtained solution was heated up to 70° C. and then to said solution was added an initiator solution C. Then the thus obtained solution was stirred for 6 hours while heated at 72±2° C., furthermore said solution was stirred for 12 hours at 80±2° C.

After that, the solution temperature was cooled to 40° C. or less and at which temperature, stirring was terminated. Said solution was then filtered with a pole-filter. Thus, latex A was obtained.

[Polymerization of Latex B: Emulsion Polymerization Process/higher Molecular Component]

Put into a 10-liter stainless steel pot were 0.55 kg of dodecylbenzenesulfonic acid sodium salt (produced by Kanto Chemical Co.) and 4.0 L of deionized pure water. The thus obtained solution was stirred at room temperature to dissolve the ingredients. Thus, anionic surfactant solution D was obtained.

Put into a 10-liter stainless steel pot were 0.14 kg of Newcol 565C (produced by Nihon Nyukazai Co.) and 4.0 l of deionized pure water. The thus obtained solution was stirred at room temperature to dissolve the ingredients. Thus, nonionic surfactant solution E was obtained.

Put into a 20-liter enameled pot were added 200.7 g of potassium peroxodisulfate (produced by Kanto Chemical Co.) and 12.0 L of deionized pure water. The thus obtained solution was stirred at room temperature to completely dissolve the ingredients. Thus, initiator solution F was obtained.

Put into a 100-liter glass lined reaction vessel (a Pfaudler impeller was used as a stirring blade) equipped with a temperature sensor, a cooling pipe, a nitrogen gas introducing pipe, and a comb-shaped baffle, were 3.41 kg of WAX emulsion (polypropylene, with a number average molecular weight of 3000, is heated to a temperature above its melting point and then dispersed to be emulsified: solid component content was 29.9%), anion surfactant solution D, and nonion surfactant solution E, and the resulting mixture was stirred, to which was added 44.0 l of deionized water. To the thus obtained solution was added a mixture consisting of 11.0 kg of styrene, 4.00 kg of n-butyl acrylate, 1.04 kg of methacrylic acid and 9.02 g of TDM (t-dodecyl mercaptan).

Subsequently, the thus obtained solution was heated to 70° C. and then to said solution was added initiator solution F. The thus obtained solution was then stirred for 6 hours while heated at 72±2° C., furthermore said solution was stirred for 12 more additional hours at 80±2° C.

After that, the solution temperature was cooled to 40° C. or less, and after which stirring was stopped. Said solution was then filtered with a pole-filter, and latex B was obtained.

[Preparation of Non-spherical Particles: Association Fusion Process]

Put into a 35-liter stainless steel pot were 5.36 kg of sodium chloride (produced by Wako Junyaku Co.) and 20.0 l of deionized water, and the thus obtained solution was stirred to totally dissolve the ingredients. Thus, sodium chloride solution G was obtained.

Put into a 2-liter glass beaker were 1.00 g of FC-170C (produced by Sumitomo 3M Co., nonionic surfactant) and 1.00 L of deionized water, and the thus obtained solution was stirred to dissolve the ingredients. Thus, nonionic surfactant solution H was obtained.

Put into a 100-liter stainless steel reaction vessel (an anchor blade was used as a stirring blade) equipped with a temperature sensor, a cooling pipe, a nitrogen gas introducing pipe, and a comb-shaped baffle, were 20.0 kg of the latex A obtained above, 5.2 kg of the latex B also obtained above, 0.4 kg of the colorant solution 1, and 20.0 l of deionized water, and the resulting mixture was stirred.

To the thus obtained solution were added a sodium chloride solution G, 6.00 kg of iso-propanol (produced by Kanto Chemical Co.), and nonion surfactant solution H, in said order.

The thus obtained solution was stirred for 6 hours upon heating at 85±2° C.

After that, the solution temperature was cooled below 40° C. and after which stirring was stopped. Said solution was filtered with a 45 $\mu$m mesh sieve to obtain a filtrate which was termed association solution (1).

[Washing Non-spherical Particles: Washing Process]

(Process 1)

The non-spherical particles in a wet-cake state were obtained by filtering the above-mentioned association solution (1).

(Process 2)

Put into a 140-liter stainless steel pot was 80 l of deionized water while stirring, using a 150 mm long turbine blade at 250 rpm. To the above-mentioned solution were added the non-spherical particles obtained in Process 1 which were pulverized into a fine particle size. To the thus obtained solution was added 5N-sodium oxide (produced by Kanto Chemical Co.) to adjust the pH of said solution to 13.0, just after completion of addition of the non-spherical particles and the thus adjusted solution was stirred for 30 minutes.

(Process 3)

The non-spherical particles in the wet-cake state were obtained through filtering the above-obtained solution by using a 0.25 $m^2$ Nutsche funnel.

(Process 4)

Put into a 140-liter stainless steel pot was 80 l of deionized water which was stirred, using a 150 mm long turbine blade at 250 rpm. To the above-mentioned solution were added the non-spherical particles obtained in Process 3 which were pulverized into a fine particle size, and the thus obtained solution was stirred for 30 minutes.

(Process 5)

The non-spherical particles in the wet-cake state were obtained through filtering the above-obtained solution by using a 0.25 $m^2$ Nutsche funnel.

(Process 6)

Process 4 and Process 5 were repeated another 7 times.

[Drying the Non-spherical Particles: Drying Process]

The non-spherical particles in the wet-cake state, which were completely washed in the above-mentioned processes, were finally obtained through filtration by using the Nutsche funnel and the thus obtained non-spherical particles were pulverized into a fine particle size, spread on trays, and dried employing a ventilator capable of expelling a 40° C. blast of air for 100 hours.

[Pulverizing Process]

The thus dried non-spherical particles in the block state were pulverized employing a Henshell pulverizer.

The particle size of the above-mentined non-spherical particles pulverized employing the Henshell pulverizer was measured at 6.90 $\mu$m employing a laser diffraction particle distribution measurement apparatus, SALD 1000 (produced by Shimazu Seisakusho, Co.).

[Process for Preparing Toners]

Non-spherical Particles 2

Colorant particles according to the present invention were obtained in the same ways as those employed in preparing the non-spherical particles 1 except that the exemplified compound D-3 was replaced with an exemplified compound D-5 (magenta dye). The colorant dispersing solution obtained in this process is referred to as "Colorant dispersing solution 2" and non-spherical particles also obtained in this process are referred to as "Non-spherical particles 2".

Non-spherical Particles 3

Colorant particles according to the present invention were obtained in the same ways as those employed in preparing the Non-spherical particles 1 except that the exemplified compound D-3 was replaced with an exemplified compound D-6 (magenta dye). Said colorant dispersing solution obtained in this process is referred to as "Colorant dispersing solution 3" and non-spherical particles also obtained in this process are referred to as "Non-spherical particles 3".

Non-spherical Particles 4

Colorant particles according to the present invention were obtained in the same ways as those employed in preparing the Non-spherical particles 1 except that the exemplified compound D-3 was replaced with an exemplified compound D-10 (yellow dye). Colorant dispersing solution obtained in this process is referred to as "Colorant dispersing solution 4" and non-spherical particles also obtained in this process are referred to as "Non-spherical particles 4".

Non-spherical Particles 5

Colorant particles according to the present invention were obtained in the same ways as those employed in preparing the Non-spherical particles 1 except that the exemplified compound D-3 was replaced with an exemplified compound D-19 (cyan dye). Colorant dispersing solution obtained in this process was referred to as "Colorant dispersing solution 5" and non-spherical particles also obtained in this process were referred to as "Non-spherical particles 5".

Non-spherical Particles 6

Colorant particles according to the present invention were obtained in the same ways as those employed in preparing the Non-spherical particles 1 except that the exemplified compound D-3 was replaced with an exemplified compound D-22 (yellow dye). Colorant dispersing solution obtained in this process is referred to as "Colorant dispersing solution 6" and non-spherical particles also obtained in this process are referred to as "Non-spherical particles 6".

Non-spherical Particles 7

Colorant particles according to the present invention were obtained in the same ways as those employed in preparing the Non-spherical particles 1 except that the exemplified compound D-3 was replaced with an exemplified compound D-71 (magenta dye). Colorant dispersion obtained in this process is referred to as "Colorant dispersing solution 7" and non-spherical particles also obtained in this process are referred to as "Non-spherical particles 7".

Non-spherical Particles 8

Colorant particles according to the present invention were obtained in the same ways as those employed in preparing the Non-spherical particles 1 except that iso-propanol used in [colorant dispersion process] was replaced with ethanol (produced by Kanto Chemical Co., S.P. value; 26.0 $J/m^3$). Colorant dispersion obtained in this process is referred to as "Colorant dispersing solution 8" and non-spherical particles also obtained in this process are referred to as "Non-spherical particles 8".

Non-spherical Particles 9

Colorant particles according to the present invention were obtained in the same ways as those employed in preparing the Non-spherical particles 1 except that iso-propanol used in [colorant dispersion process] was replaced with methanol (produced by Kanto Chemical Co., S.P. value; 29.7 $J/m^3$). Colorant dispersing solution obtained in this process is referred to as "Colorant dispersing solution 9" and non-spherical particles also obtained in this process are referred to as "Non-spherical particles 9".

Non-spherical Particles 10

Colorant particles according to the present invention were obtained in the same ways as those employed in preparing the Non-spherical particles 3 except that iso-propanol used in [colorant dispersion process] was replaced with ethanol (produced by Kanto Chemical Co., S.P. value; 26.0 $J/m^3$). Colorant dispersion obtained in this process is referred to as "Colorant dispersion 10" and non-spherical dispersion also obtained in this process are referred to as "Non-spherical dispersion 10".

Non-spherical Particles 11

Colorant particles according to the present invention were obtained in the same ways as those employed in preparing the Non-spherical particles 5 except that iso-propanol used in [colorant dispersion process] was replaced with acetone (produced by Kanto Chemical Co., S.P. value; 20.3 $J/m^3$). Colorant dispersing solution obtained in this process is referred to as "Colorant dispersing solution 11" and non-spherical particles also obtained in this process are referred to as "Non-spherical particles 11".

Non-spherical Particles 12

Colorant particles according to the present invention were obtained in the same ways as those employed in preparing the Non-spherical particles 7 except that iso-propanol used in [colorant dispersion process] is replaced with methy ethyl ketone (produced by Kanto Chemical Co., S.P. value; 19.0 $J/m^3$). Colorant dispersing solution obtained in this process is referred to as "Colorant dispersing solution 12" and non-spherical particles also obtained in this process are referred to as "Non-spherical particles 12".

Non-spherical Particles 13

Colorant particles according to the present invention were obtained in the same ways as those employed in preparing the Non-spherical particles 1 except that sodium benzensulfonate used in [emulsion polymerization process/lower molecular component] was replaced with Adeka Hope LS-90 (n-dodecylsulfuric acid sodium salt, produced by Asahi Denka Co.). Colorant dispersing solution obtained in this process is referred to as "Colorant dispersing solution 13" and non-spherical particles also obtained in this process are referred to as "Non-spherical particles 13".

Non-spherical Particles 14

Colorant particles according to the present invention were obtained in the same ways as those employed in preparing the Non-spherical particles 4 except that sodium benzensulfonate used in [emulsion polymerization process/lower molecular component] and [emulsion polymerization process/higher molecular component] was replaced with Adeka Hope LS-90 (n-dodecylsulfuric acid sodium salt, produced by Asahi Denka Co.). Colorant dispersing solution obtained in this process is referred to as "Colorant dispersing solution 14" and non-spherical particles also obtained in this process are referred to as "Non-spherical particles 14".

Non-spherical Particles 15

| Monomer composition | |
|---|---|
| Monomers necessary for polymerization | |
| Styrene | 90 kg |
| Butyl methacrylate | 10 kg |
| Colorant | |
| Exemplified compound D-5 | 5 kg |
| Fixing enhancement agent | |
| Polypropylene | 5 kg |

The above-mentioned monomer composition was sufficiently mixed employing a sand grinder so that said monomer composition was uniformly blended. To the thus obtained monomer composition was added 1.8 kg of 2,2-azo-bis(2,4-dimethylvaleronitrile) an a polymerization initiator.

| Aqueous medium | |
|---|---|
| (A) Tri-sodium phosphate 12 hydrate ($Na_3PO_4 .12H_2O$) | 25.6 parts |
| Sodium dodecylbenzenesulfonic acid ($C_{12}H_{25}C_6H_4SO_3Na$) | 0.04 parts |
| Water ($H_2O$) | 53.4 parts |
| (B) Calcium chloride ($CaCl_2$) | 11.2 parts |
| Water ($H_2O$) | 102.0 parts |

The above-mentioned (A) and (B) were mixed to prepare an aqueous medium containing an almost non-water soluble inorganic compound $[Ca_3(PO_4)_2]$.

(Preparation of Suspension Solution)

The ratio of the monomer composition weight to the aqueous medium weight was adjusted to 0.57 and the concentration of a dispersant to the monomers necessary for polymerization was adjusted to 20%. The thus adjusted monomer composition was added to the above-mentioned aqueous medium, and said obtained mixture was stirred at 10000 rpm for 30 min., employing a homomixer (produced by Tokusyu Kika Co., Ltd.) to prepare a suspension solution.

(Polymerization Reaction)

The thus obtained suspension solution was stirred at 200 rpm under a nitrogen gas atmosphere for 5 hours while heating at 70° C. so that the monomers contained in said suspension solution were polymerized. Thus, polymerized particles were obtained.

(After-treatment)

Next, the solution containing said polymerized particles obtained above was cooled down to room temperature and said solution was poured into a hydrochloric acid aqueous solution (pH=2) to completely dissolve the almost non-water soluble inorganic compound $[Ca_3(PO_4)_2]$, after which the thus obtained solution was washed, filtered, dried so as to obtain a suspension polymerization toner.

Comparative Non-spherical Particles 1

100 parts of styrene-n-butylacrylate copolymer (copolymerization ratio=85:15, weight average molecular weight=52000, at two peaks distribution), 10 parts of the exemplified compound D-3, and 5 parts of low molecular polypropylene (number average molecular weight=3200) were blended. The resulting mixture was kneaded, pulverized, and classified to obtain comparative colorant particles. The comparative colorant particles obtained in this process are referred to as "Comparative non-spherical particles 1".

Comparative Non-spherical Particles 2

100 parts of styrene-n-butylacrylate copolymer (copolymerization ratio=85:15, weight average molecular weight=82000, at one peak distribution), 10 parts of an exemplified compound D-5, and 5 parts of low molecular polypropylene (number average molecular weight=3200) were mixed. The resulting mixture was kneaded, pulverized, and classified to obtain comparative colorant particles. The comparative colorant particles obtained in this process were referred to as "Comparative non-spherical particles 2".

Comparative Non-spherical Particles 3

A comparative colorant particles were obtained in the same ways as those employed in preparing the Non-spherical particles 1 except that the exemplified compound D-3 was replaced with C. I. Pigment Red 122. The thus obtained comparative colorant particles are referred to as "Comparative non-spherical particles 3".

Comparative Non-spherical Particles 4

Comparative colorant particles were obtained in the same ways as those employed in preparing said Non-spherical particles 1 except that the exemplified compound D-3 was replaced with C. I. Pigment Yellow 17. The thus obtained comparative colorant particles are referred to as "Comparative non-spherical particles 4".

Comparative Non-spherical Particles 5

Comparative colorant particles were obtained in the same ways as those employed in preparing the Non-spherical particles 1 except that the exemplified compound D-3 was replaced with C. I. Pigment Blue 15:3. The thus obtained comparative colorant particles are referred to as "Comparative non-spherical particles 5".

[Preparation of the Toner]

Toners were obtained by adding 1 wt % of hydrophobic silica (primary number average particle diameter=12 nm) to the above-mentioned "Non-spherical particles 1" through "Non-spherical particles 15" and "Comparative non-spherical particles 1" through "Comparative non-spherical particles 5". These toners are referred to as "Toner 1" through "Toner 15" and "Comparative toner 1" through "Comparative toner 5".

Evaluation (Physical Properties-characteristics)

Measurement of particle size, coefficient of variation of particle size distribution, and toner characteristics for the above-mentioned "Non-spherical particles 1" through "Non-spherical particles 15", and "Comparative non-spherical particles 1" through "Comparative non-spherical particles 5" was conducted and the obtained results are shown below.

(Particle Size, Coefficient of Variation of Particle Size Distribution)

Measuring method: the particle size of D50 (μm) and the coefficient of variation (CV) of particle size distribution were measured employing a laser diffraction particle distribution measurement apparatus, SALD 1100 (produced by Shimazu Seisakusho, Co.).

TABLE 1

| | SALD 1100 measurement results | |
|---|---|---|
| Particles No. | D50 (μm) | CV |
| A-1 | 6.94 | 19.9 |
| A-2 | 7.21 | 20.9 |
| A-3 | 6.75 | 23.9 |
| A-4 | 6.23 | 24.6 |
| A-5 | 6.92 | 19.2 |
| A-6 | 7.04 | 19.7 |
| A-7 | 7.14 | 18.6 |
| A-8 | 6.85 | 18.4 |
| A-9 | 6.90 | 21.9 |
| A-10 | 7.11 | 19.2 |
| A-11 | 6.43 | 18.7 |
| A-12 | 6.66 | 20.9 |
| A-13 | 6.92 | 23.9 |
| A-14 | 7.45 | 22.6 |
| A-15 | 6.59 | 28.9 |
| B-1 | 6.68 | 23.2 |
| B-2 | 6.92 | 23.2 |
| B-3 | 7.39 | 22.4 |
| B-4 | 7.13 | 22.5 |
| B-5 | 7.20 | 22.6 |

D50 (μm); Particle size, CV; Coefficient of variation of particle size, A; Non-spherical particles, B; Comparative non-spherical particles

[Preparation of the Carrier]

Into a high speed stirring-type mixer, were put 40 g of fine particles of a styrene/methylmethacrylate copolymer consisting of a ratio of 6/4 and 1,960 g of Cu—Zn ferrite particles with a specific gravity of 5.0 and a weight average diameter of 45 μm, exhibiting a saturation magnetization of 60 emu/g when external magnetization of 1,000 oersted is applied. The resultant mixture was blended at a mixture's temperature of 30° C. for 15 minutes; thereafter, the mixture was subjected to repeated mechanical impact for 30 minutes, while kept at a mixture's temperature of 105° C., and then cooled to obtain a carrier.

[Preparation of the Developer]

A mixture consisting of 418.5 g of the above-mentioned carrier and 31.5 g of each toner were mixed for 20 minutes employing a V-type mixer to obtain a developer for practical image testing.

[Apparatus and Conditions Employed for Evaluation]

In the present Example, evaluation on the practical image formation was carried out employing a Konica 9028 (manufactured by Konica Co.) as an image-forming apparatus.

[Evaluation Items and Evaluation Methods]

According to the above-mentioned image-forming method, a reflection-type image (an image formed on a sheet of plain paper) and a transmission-type image (an image formed on an OHP) were prepared on a sheet of paper and an OHP, respectively, employing a developer comprising the color toner of the present invention, and were evaluated according to the methods described below. Further, for said evaluation, the amount of allowable adhered toner was adjusted to the range of 0.7±0.05 mg/cm$^2$.

Chroma

The chroma of the image formed on a sheet of plain paper was measured and compared employing a Macbeth Color-Eye 7000. The preferable level is at least 80 for Y (yellow), at least 80 for M (magenta), and at least 55 for C (cyan).

Light Fastness

A fading exposure test lasting 7 days was conducted using the "Xenon Long Life Weather Meter" manufactured by Suga Shikenki Co. (employing a Xenon arc lamp, 70,000 lux, 44.0° C.). Thereafter, the difference in color between before and after the test was measured by the use of Macbeth Color-Eye 7000, and then, the hue difference was compared.

Transparency

The transparency of the OHP image was evaluated by the following method.

The spectral transmittance of the visible region of the image was measured using a "330 Type Automatic Recording Spectrophotometer", manufactured by Hitachi, Co., Ltd., while utilizing an OHP transparency with no toner image as a reference and the spectral transmittances at 570 nm for yellow, at 650 nm for magenta and 500 nm for cyan were obtained thereby to make a scale for the evaluation of the transparency of the OHP image.

Hue variation: hue variation between the image formed on a plain paper and the image formed on OHP was measured by employing Macbeth Color-Eye 700, and compared.

[Evaluation Result]

The obtained results are shown in Table 2.

TABLE 2

| | | | Evaluation results | | | |
|---|---|---|---|---|---|---|
| Toner No. | Exemplified dye | Classification of Y, M, C | Chroma | Light fastness | Transparency | Hue variation |
| I.T. 1 | D-3 | C | 58.9 | 0.1 | 88.4 | −11.3 |
| I.T. 2 | D-5 | M | 80.8 | 0.1 | 71.1 | −9.3 |
| I.T. 3 | D-6 | M | 80.4 | 0.1 | 70.2 | −9.5 |
| I.T. 4 | D-10 | Y | 98.5 | 0.1 | 78.8 | −2.0 |
| I.T. 5 | D-19 | C | 58.8 | 0.1 | 87.2 | −11.5 |
| I.T. 6 | D-22 | Y | 98.6 | 0.1 | 78.7 | −2.1 |
| I.T. 7 | D-71 | M | 80.5 | 0.1 | 70.3 | −9.4 |
| I.T. 8 | D-3 | C | 58.6 | 0.1 | 89.4 | −11.0 |
| I.T. 9 | D-5 | M | 80.2 | 0.1 | 71.1 | −9.2 |
| I.T. 10 | D-6 | M | 80.4 | 0.1 | 70.5 | −9.0 |
| I.T. 11 | D-19 | C | 58.2 | 0.1 | 87.8 | −11.1 |
| I.T. 12 | D-71 | M | 79.9 | 0.1 | 70.8 | −9.5 |
| I.T. 13 | D-3 | C | 58.2 | 0.1 | 88.0 | −11.9 |
| I.T. 14 | D-10 | Y | 98.1 | 0.1 | 77.8 | −3.1 |
| I.T. 15 | D-5 | M | 78.2 | 0.2 | 68.9 | −12.3 |
| C.T. 1 | D-3 | C | 52.5 | 0.7 | 75.1 | −23.9 |
| C.T. 2 | D-5 | M | 75.2 | 0.8 | 61.7 | −21.6 |
| C.T. 3 | C.I. Pigment Red 122 | M | 70.9 | 5.1 | 55.8 | −31.5 |
| C.T. 4 | C.I. Pigment Yellow 17 | Y | 69.1 | 0.2 | 60.8 | −4.1 |
| C.T. 5 | C.I. Pigment Blue 15:3 | C | 48.2 | 8.1 | 70.0 | −35.9 |

T.; Inventive Toner, C.T.; Comparative Toner

As can be seen from Table 2, the present inventive color toners produce a faithful color reproduction quality and high quality of OHP image. Accordingly, the present inventive color toners are suitable for the use of full color toners. Further, since the light fastness of these color toners is excellent, said color toners can provide an image capable of being preserved over a long period of time.

What is claimed is:

1. A process for preparing a color toner for developing an electrostatic image comprising polymerizing monomers to form primary resin particles, wherein the color toner comprises the primary resin particles and a metal complex dye represented by the following formula (1) or formula (2), Formula (1)

$$M\text{--}[\text{-}X^1{=}L^1{-}(L^2{=}L^3)_m{-}Y^1]_{n1}$$

Formula (2)

$$M\text{--}[\text{-}X^3{-}N{=}N{-}Y^3]_{n2}$$

wherein, $X^1$ and $X^3$ each are a group of atoms bonding with each other which can form at least bidentate coordination bond with a metal ion; $y^1$ represents an aromatic hydrocarbon ring, a 5- or 6-membered heterocyclic ring or $—L^4{=}Y^2$; $Y^2$ and $Y^3$ each represent an aromatic hydrocarbon ring or a 5- or 6-membered heterocyclic ring; $L^1$ and $L^4$ each represent a substituted or an unsubstituted methine group, or a nitrogen atom; $L^2$ and $L^3$ each represent a substituted or an unsubstituted methine group; M represents a metal ion which can form at least a bidentate coordination bond with said group of atoms bonding with each other represented by $X^1$ and $X^3$; m represents an integer of 0, 1, 2 or 3; n1 and n2 each represent an integer of 1, 2 or 3.

2. A process for preparing a color toner for developing an electrostatic image comprising;

(a) polymerizing monomers to obtain resin particles, (b) associating said resin particles, wherein the color toner comprises the associated resin particles, and a metal complex dye represented by the following formula (1) or formula (2), Formula (1)

$$M\text{--}[\text{-}X^1{=}L^1{-}(L^2{=}L^3)_m{-}Y^1]_{n1}$$

Formula (2)

$$M\text{--}[\text{-}X^3{-}N{=}N{-}Y^3]_{n2}$$

wherein, $X^1$ and $X^3$ each are a group of atoms bonding with each other which can form at least bidentate coordination bond with a metal ion; $Y^1$ represents an aromatic hydrocarbon ring, a 5- or 6-membered heterocyclic ring or $—L^4{=}Y^2$; $Y^2$ and $Y^3$ each represent an aromatic hydrocarbon ring or a 5- or 6-membered heterocyclic ring; $L^1$ and $L^4$ each represent a substituted or an unsubstituted methine group, or a nitrogen atom; $L^2$ and $L^3$ each represent a substituted or an unsubstituted methine group; M represents a metal ion which can form at least a bidentate coordination bond with said group of atoms bonding with each other represented by $X^1$ and $X^3$; m represents an integer of 0, 1, 2 or 3; n1 and n2 each represent an integer of 1, 2 or 3.

3. The process of claim 2, wherein the absorption maximum of said metal complex dye represented by the formula (1) or formula (2) described above is between 350 and 850 nm.

4. The process of claim 2, wherein said metal complex dye is added prior to the completion of an association of resin particles.

5. A process for preparing a color toner for developing an electrostatic image comprising (a) polymerizing monomers to obtain resin particles, (b) associating said resin particles, wherein the color toner comprises the associated resin particles and a metal complex dye represented by the following formula (3) or (4)

Formula (3)

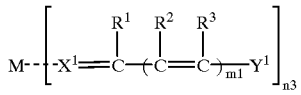

Formula (4)

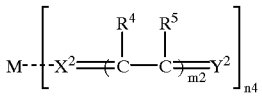

wherein $X^1$ and $X^2$ each are a group of atoms bonding with each other which can form at least a bidentate coordination bond with a metal ion; $R^1$, $R^2$, $R^3$, $R^4$ and $R^5$ each represent a hydrogen atom or a monovalent substituent group; $Y^1$ and $Y^2$ each represent an aromatic hydrocarbon ring or a 5- or 6-membered heterocyclic ring; M represents a metal ion which can form at least a bidentate coordination bond with said group of atoms bonding with each other represented by $X^1$ or $X^2$; m1 or m2 represents an integer of 0, 1, 2 or 3; n3 or n4 represents an integer of 1, 2 or 3.

6. The process of claim 5, wherein $X^1$ or $X^2$ of the formula (3) or formula (4) is represented by the following formula (8), formula (9), formula (10) or formula (11)

Formula (8)

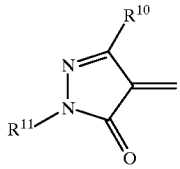

Formula (9)

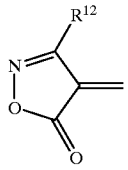

Formula (10)

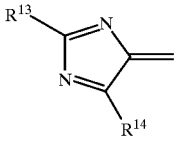

Formula (11)

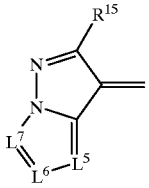

wherein $L^5$ represents a nitrogen atom or $—CR^{17}{=}$; $L^6$ represents a nitrogen atom or $—CR^{18}{=}$; $L^7$ represents a nitrogen atom or $—CR^{19}{=}$; $R^{17}$, $R^{18}$ and $R^{19}$ represent a hydrogen atom or a monovalent substituent group; at least one of $R^{17}$, $R^{18}$ and $R^{19}$ represents a group of atoms bonding with each other which can form at least a bidentate coordination bond with a nitrogen atom of the formula (11) ; $R^{10}$, $R^{11}$, $R^{12}$, $R^{13}$, $R^{14}$ and $R^{15}$ each represent a hydrogen atom or a monovalent substituent group; at least one of $R^{10}$ and $R^{11}$ represents a group of atoms bonding with each other which can form at least a bidentate coordination bond with a nitrogen atom of the formula (8); $R^{12}$ represents a group of atoms bonding with each other which can form at least a bidentate coordination bond with a nitrogen atom of the formula (9); at least one of $R^{13}$ and $R^{14}$ represents a group of atoms bonding with each other which can form at least a bidentate coordination bond with a nitrogen atom of the formula (10).

7. The process of claim 6, wherein a colorant is represented by the formula (3) or formula (4) described above.

8. The process of claim 5, wherein a colorant contains at least a metal complex dye represented by the following formula (3), Formula (3)

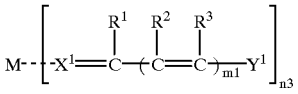

wherein, $X^1$ is a group of atoms bonding with each other which can form at least a bidentate coordination bond with a metal ion; $R^1$, $R^2$ and $R^3$ each represent a hydrogen atom or a monovalent substituent group; $Y^1$ represent an aromatic hydrocarbon ring or a 5- or 6-membered heterocyclic ring; M represents a metal ion which can form at least a bidentate coordination bond with said group of atoms bonding with each other represented by $X^1$; m1 represents an integer of 0, 1, 2 or 3; n3 represents an integer of 1, 2 or 3.

9. The process of claim 5, wherein a colorant contains at least a metal complex dye represented by the following formula (4), Formula (4)

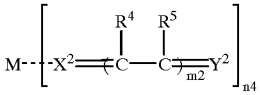

wherein, $X^2$ is a group of atoms bonding with each other which can form at least a bidentate coordination bond with a metal ion; $R^4$ and $R^5$ each represent a hydrogen atom or a monovalent substituent group; $Y^2$ represent an aromatic hydrocarbon ring or a 5- or 6-membered heterocyclic ring; M represents a metal ion which can form at least a bidentate coordination bond with said group of atoms bonding with each other represented by $X^2$; m2 represents an integer of 0, 1, 2 or 3; n4 represents an integer of 1, 2 or 3.

10. The process of claim 2, wherein at least two atoms, being contained in $X^1$ or $X^3$ of the metal complex dye represented by the formula (1) or formula (2) described above, and forming a coordination bond, are nitrogen atoms.

11. The process of claim 2, wherein a chemical structure represented by $X^1$ of the metal complex dye represented by the formula (1) described above is represented by the following formula (6)

Formula (6)

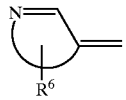

wherein $R^6$ represents a hydrogen atom or a monovalent substituent group.

12. The process of claim 2, wherein a chemical structure represented by $X^3$ of the metal complex dye represented by the formula (2) described above is represented by the following formula (7)

Formula (7)

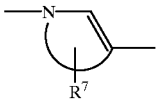

wherein $R^7$ represents a hydrogen atom or a monovalent substituent group.

13. The process of claim 2 wherein $X^1$ or $X^3$ of Formula (1) or Formula (2) is represented by Formula (8)

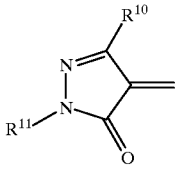

Formula (9)

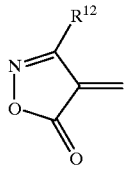

Formula (10)

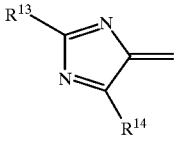

Formula (11)

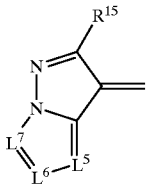

wherein $L^5$ represents a nitrogen atom or —$CR^{17}$═; $L^6$ represents a nitrogen atom or —$CR^{18}$═; $L^7$ represents a nitrogen atom or —$CR^{19}$═; $R^{17}$, $R^{18}$ and $R^{19}$ represent a hydrogen atom or a monovalent substituent group; at least on of $R^{17}$, $R^{18}$ and $R^{19}$ represents a group of atoms bonding with each other which can form at least a bidentate coordination bond with a nitrogen atom of the formula (11); $R^{10}$, $R^{11}$, $R^{12}$, $R^{13}$, $R^{14}$ and $R^{15}$ each represent a hydrogen atom or a monovalent substituent group; at least one of $R^{10}$ and $R^{11}$ represents a group of atoms bonding with each other which can form at least a bidentate coordination bond with a nitrogen atom of the formula (8); $R^{12}$ represents a group of atoms bonding with each other which can form at least a bidentate coordination bond with a nitrogen atom of the formula (9); at least one of $R^{13}$ and $R^{14}$ represents a group of atoms bonding with each other which can form at least a bidentate coordination bond with a nitrogen atom of the formula (10).

14. The process of claim 2, wherein said metal ion represented by M of the formula (1) and formula (2) is an ion of Ni, Cu, Co, Cr, Zn, Fe, Pd or Pt.

15. The process of claim 4, wherein said metal complex is dispersed in the presence of a water-soluble organic solvent having S.P. value of not less than 19 $J/m^3$ after the completion of adding said metal complex.

16. The process of claim 1, wherein a particle size of said primary particles of the resin particles is between 0.01 and 10 $\mu$m.

17. The process of claim 15, wherein a dispersion process is carried out in the presence of water and a water-soluble organic solvent.

18. The process of claim 17, wherein the weight ratio of said water-soluble organic solvent to water is between 1:99 and 1:1.

19. The process of claim 15, wherein an association process is carried out by adding a coagulant, or an aqueous solution containing said coagulant, as well a s an infinitely water-soluble organic solvent.

20. The process of claim 1, wherein monomers are polymerized in the presence of said metal complex dye.

21. The process of claim 19, wherein said coagulant is added in an amount of not less than critical coagulation concentration, and said association process is carried out between a temperature of 5° C. higher than Tg of the resin particles and a temperature of 50° C. lower than Tg of the resin particles.

* * * * *